US005719828A

United States Patent [19]

Haas et al.

[11] Patent Number: 5,719,828

[45] Date of Patent: *Feb. 17, 1998

[54] PATTERNED INDICATORS

[75] Inventors: Sandra F. Haas; David J. Haas, both of Suffern, N.Y.

[73] Assignee: Temtec, Inc.

[ * ] Notice: The portion of the term of this patent subsequent to Oct. 15, 2008, has been disclaimed.

[21] Appl. No.: 602,120

[22] Filed: Oct. 22, 1990

Related U.S. Application Data

[63] Continuation-in-part of Ser. No. 460,753, Jan. 4, 1990, Pat. No. 5,058,088.

[51] Int. Cl.[6] ..... G04B 17/00

[52] U.S. Cl. ..... 368/327; 116/200

[58] Field of Search ..... 368/327, 62, 114, 368/121; 116/200, 207, 219, 308

[56] References Cited

U.S. PATENT DOCUMENTS

| | | | |
|---|---|---|---|
| 3,520,124 | 7/1970 | Meyers | 368/327 |
| 4,212,153 | 7/1980 | Kydonieus et al. | 368/327 |
| 4,408,557 | 10/1983 | Bradley et al. | 368/327 |
| 4,643,122 | 2/1987 | Seybold | 368/327 |
| 4,903,254 | 2/1990 | Haas | 368/327 |
| 5,058,088 | 10/1991 | Haas et al. | 368/327 |
| 5,107,470 | 4/1992 | Pedicano et al. | 368/327 |

*Primary Examiner*—Bernard Roskoski
*Attorney, Agent, or Firm*—Michael E. Zall

[57] ABSTRACT

A patterned indicator is provided which contains latent information. The patterned indicator includes a first substrate having first and second surfaces, the first surface having a uniform pattern printed of an ink thereon. A second transparent substrate having first and second surfaces is also provided. An adhesive activator is provided on the first surface of the second substrate. The indicator is activated by placement of the first surfaces of the first and second substrates into adhesive contact such that the ink and adhesive activator coact to cause the ink pattern to gradually bleed and blend together to cause a change visually perceptible through the transparent substrate in a selected time interval.

A preferred embodiment of the invention is a parking permit, while other preferred embodiments include transit tickets, admission tickets, time passage indicators for other applications. Also within the scope of this invention are patterned indicators printed with inks having multiple sensitivities for indicating tampering with goods in packages sealed with such indicators.

74 Claims, 16 Drawing Sheets

112
100
120A
126
120B
124
120H
122
120G
118
114
116
120F
120E
120D
120C
144
130
128

120F
132F
134
118
114
116
120E
144
124
126
122

126
134
132F
116
120F
132F
122
134
114
124
130
118
144

112
160A
160B
160H
160C
160G
160F
160D
160E
114
H
A
B
G
C
F
E
D
170
130
122

114
170
160F
122

PATTERNED INDICATORS

RELATED APPLICATIONS

This application is a Continuation-In-Part application of U.S. application Ser. No. 07/460,753, filed Jan. 4, 1990, now U.S. Pat No. 5,058,088 entitled, "Time Indicator," the entire disclosure of which is incorporated herein by reference.

BACKGROUND OF THE INVENTION

1. Field of the Invention

This invention relates to patterned indicators, wherein latent information is contained within a pattern. The latent is revealed upon the application of an activator or stimulus to the pattern.

In particular, this invention relates to an indicator wherein the relative amount of time that has elapsed from the initial activation of the indicator can be rapidly and easily determined by the progression of a visually perceptible change in color along different areas of the indicator. Also this invention relates to indicators wherein a latent pattern hidden in an array is brought forth upon application of activator or stimulus or after a period of time to reveal or conceal information. This invention also relates to a novel means for adjusting selected time periods for such indicators. Further, this invention relates to security indicators that expose latent information upon being attacked in various manners.

2. Prior Art

Numerous devices are known which provide a visual indication of the passage of a pre-arranged amount of time. Such time indicators are useful, for example, when attached to perishable items for indicating the length of time the items have been on the wholesaler's or retailer's shelf. Thus, foods and other perishable items such as photographic materials can be provided with indicators which after being activated, evidence a visual change, after the passage of a predetermined period of time. Time-temperature indicators are also known which indicate a visual change as a function of both time and temperature. Virtually any time indicator however is also, at least to a minor extent, dependent upon temperature.

Applicant is aware of the following prior art, none of which teach or suggest the claims of this invention.

U.S. Pat. No. 3,018,611 to Biritz describes a time indicator device which may be used for frozen foods, parking times, construction periods, etc. The device comprises a backing which is attachable to the outer surface of, for example, a package of frozen food. Superimposed on the backing is a strip of filter paper having a chemical reagent laminated thereto. The chemical reagent is an oxygen reactive material. The strip is hermetically sealed by a covering of transparent, impervious pressure sensitive cellophane which allows visual inspection of the oxygen reactive layer. A pin-hole size opening is provided in the covering to allow for ingress of air within the interior of the container. This opening is sealed by a removable tape. When the tape is removed the oxygen reactive material reacts to change color by permitting air to enter and diffuse into the container to make contact with the material. The pin-hole opening is provided at one end of the container and as time proceeds, the color proceeds toward the other unexposed end of the container.

U.S. Pat. No. 3,520,124 to Myers, describes a parked car time indicator which includes a first sheet having a first reactant and a second sheet having a second reactant, and a release sheet, which is peeled away to permit contact of the first sheet with the second sheet to start a reaction over a selective time interval terminating with a color change of the reactants.

U.S. Pat. No. 3,480,402 to Jackson, describes a time indicator formed of an absorbent carrier having absorbed thereon at least one chemical compound which changes color upon exposure to oxygen. The carrier and chemical compound absorbed thereon are protected from ambient oxygen by a non-perforated barrier layer which is transparent and through which atmospheric oxygen can controllably diffuse over a preselected period of time. Thus, when the chemical compound changes color, the preselected period of time is indicated. The graduated time indicator may be produced by utilizing more than one chemical or a layer covering the various pieces of absorbent material of different thickness. For each piece of absorbent material, the chemical absorbed on the piece of absorbent material would change color at different times, e.g., the chemical on one piece would change color after, say, one week, and the chemical absorbed on another piece would change color after ten days, and the chemical on a further piece of absorbent material would change color after fourteen days. Thus, a graduated time indicator is described.

U.S. Pat. Nos. 3,954,011 and 3,962,920 to Manske, describes a time indicating device suitable for visibly measuring parameters such as time, temperature and time-temperature relationships. The device includes a porous fluid-carrying pad, a wick material for said fluid and an indicator means whereby the progress of fluid along the wick material can be visibly indicated and used to measure the passage of time, the exposure to a given minimum temperature or time-temperature relationship.

U.S. Pat. No. 4,028,876 to Delatorre describes an apparatus for visually indicating elapsed time by a color change which comprises a transparent container having a rupturable capsule therein and in which a first composition is contained. A transparent matrix surrounds the second composition which is also in the container. The device may be secured to a surface by means of a mechanical fastener or an adhesive layer.

U.S. Pat. No. 4,212,153 to Kydonieus, et al describes a laminated indicator which changes in a visually perceptible mode with the passage of time. The indicator comprises at least two layers whereby the molecular migration of an agent in an interior layer to the outermost surface of the exterior layer causes a change which is visually perceptible. This reference also describes the use of a step-wedge test color panel placed next to the indicator which is used to compare the developed color or shade. The step-wedge can be provided with indicia corresponding to the time period required to develop the color at each step of the wedge.

Attention is also drawn to U.S. Ser. No. 07/401,080 entitled "Time Indicator Enhancement Method", filed Aug. 31, 1989, and now U.S. Pat. No. 4,903,254, which is an improvement of the aforementioned patent, U.S. Pat. No. 4,212,153 to Kydonieus et al. In that it provides a time indicator badge which provides a clear indication of the expiration of time.

U.S. Pat. No. 4,229,813 to Lilly, et al describes a time indicator which utilizes a silicon oil which is slowly absorbed onto and moves up a porous strip at a rate which is a function of time. One side of the strip is printed with an oil soluble ink, while the other side is unprinted. The printed side of the strip is laminated with polyethylene film to an unprinted strip. As the silicon oil moves up the strip, the oil contacts the ink causing a dye in the ink to migrate from the printed side to the unprinted side, thus providing a measurable color front moving up the strip.

U.S. Pat. No. 4,382,700 to Youngren describes an indicator which contains a mineral jelly which is in contact with a wick, such that the mineral jelly diffuses into the paper in accordance with the changes in ambient temperature over a period of time.

U.S. Pat. No. 4,408,557 to Bradley, et al describes a timer comprising an absorptive layer disposed on a base layer which accepts a carrier mixture at a predetermined rate. A barrier means is disposed between the carrier mixture and the absorptive layer, and the removal of the barrier activates the timer.

U.S. Pat. No. 4,629,330 to Nichols describes a color change indicator which includes a liquid having a predetermined index of refraction and a rate of evaporation, a reservoir for holding liquid, and an opacifying layer of microporous material. The opacifying layer has an index of refraction approximately the same as that of a liquid and overlies the reservoir. The opacifying layer has an open cell network of pores for absorbing liquid from the reservoir and is in a first radiation scattering condition when the liquid occupies the opacifying layer, and in a second scattering condition when the liquid is depleted from the opacifying layer.

U.S. Pat. No. 4,643,122 to Seybold describes a diffusion controlled security tag comprising a carrier containing a solution of a compound which changes color upon diffusion or evaporation of the solvent. The carrier is enveloped in a barrier film which controls the rate of diffusion/evaporation of the solvent from the carrier, such that a change in color of the carrier indicates undesirable storage or product tampering.

One of the problems associated with all of the foregoing devices is that they are complicated to adjust for a selected period of time. Adjustment often involves experimentation with many types of inks, solvents, wicks, etc. to prepare a device which can operate under the conditions expected. Additionally, very few of these devices can indicate the relative length of time that has elapsed since the device was activated, i.e., it is difficult to determine what fraction of the selected period of time has elapsed. Most of the prior art devices gradually change color over a period of time and involve, at best, a guess on how much time has elapsed. When this is combined with the possible variations in temperature, humidity, etc. that may exist in the environment of the time indicator, the viewer has very little confidence that he is close to the expiration time of the device.

A need thus exists for an indicator which is inexpensive and can clearly, relatively accurately and quickly indicate the lapse of progressive selected periods of time increments. Also, there is a need for indicators which provide information upon the passage of discrete time intervals. Further, there is a need for self-expiring or self-canceling tickets to prevent reuse and counterfeiting. Further still, there is a need for a means for easily adjusting the selected period of time without the cumbersome trial and error methods used in the past.

In a related aspect of this inventions, there is also a need for maintaining the security of sealed packages. Enormous sums are lost each year by industry from theft occurring during transportation of goods in packages. Thieves simply open the packages in which goods are transported, remove goods, and reseal the packages. The unwary purchaser is thereby victimized. There is thus a need for tamper indicating security means which requires merely a brief visual inspection of the package in which the goods are transported to determine whether the package has been tampered with.

OBJECTS AND SUMMARY OF THE INVENTION

It is an object of this invention to provide a time indicator device which can provide the user with a clear indication of the increments of time that have elapsed since activation of the device.

It is a further object of this invention to provide a time indicator device wherein the means for adjusting the selected period of time of the device can be easily and simply adjusted.

It is still a further object of this invention to provide a self-expiring parking permit which enables a parking attendant to determine from a relatively long distance whether the parking permit has expired.

It is yet another object of this invention to provide a parking time indicator which can function inside a sealed vehicle which experiences large variations of temperature and can indicate the relative elapsed time.

It is still another object of this invention to provide a parking time indicator which is disposable, can be transferred from one vehicle to another and is relatively inexpensive.

It is a further object of this invention to provide a parking time indicator which can be customized for the particular needs of the parking lot, and wherein the possibility of duplication or counterfeiting is minimized.

It is another object of this invention to provide self-expiring transportation tickets, passes and transfers, including admission tickets for parks, theater and other events which expire upon the passing of set intervals, including one day tickets, one week tickets, one month tickets and tickets of other time intervals.

It is a further object of this invention to provide a patterned indicator on continuously changing ticket which is not easily counterfeited.

It is still another object of this invention to provide a wrist band ticket which self-expires wherein the wrist band ticket wraps around the wrist of a person to prevent the transfer of the ticket.

It is even another object of this invention to provide a warning label or sign which the warning message self-expires or disappears after a specified interval of time.

It is yet another object of this invention to provide self-expiring security tape for use in customs and checked baggage facilities wherein the security tape self-expires after set intervals to prevent reissue thereof.

It is yet another object of this invention to provide a self-changing retail sticker wherein a sticker is applied to purchased goods at the point of purchase and the sticker self-expires to prevent the purchaser from reusing the sticker at another time.

It is still a further object of this invention to provide a shelf life indicator which is applied to products having shelf lives wherein the indicator changes color or words develop after specified intervals of time corresponding to the shelf life of the particular product.

It is yet a further object of this invention to provide a product age indicator wherein the indicator is applied to products prior to transportation, and the indicator changes with time to show the relative age of the product so that older products may be sold prior to new products.

It is still another object of this invention to provide a label for use with pharmaceutical products which self-expires upon reaching the end of the useful life of the product.

It is even another object of this invention to provide a price tag which, after a time interval, changes to indicate a reduced price.

It is even a further object of this invention to provide a game wherein answers or solutions to questions or problems become visible after the passage of a time interval.

Yet another object of this invention is to provide an advertising or promotional product wherein latent information becomes visible after a specified interval of time.

It is even a further object of this invention to provide an indicator which indicates that service is required after the passage of an interval of time, for use in such applications as changing oil, changing lubricants, changing water, etc.

It is yet a further object of this invention to provide an indicator which, after the passage of an interval of time, indicates that a product should be replaced, e.g., an air filter, a water filter, batteries, etc.

It is still a further object of this inventions to provide a time indicator for accurately indicating the passage of long periods of time, including months and even years.

It is yet another object of this invention to provide a visitor pass having a void pattern printed faintly thereon, which, after activation, grows dark to indicate expiration of the pass.

It is even a further object to provide a patterned indicator for indicating tampering with a package wherein such indication is not evident to the tamperer.

It is still a further object of this invention to provide a tamper indicating packaging tape which indicates that a package has been tampered with when water, an organic solvent or heat is applied to the packaging tape, or when the packaging tape is cut and resealed with a clear adhesive tape.

Generally, this invention pertains to a patterned indicator comprising a pattern which, upon application of a stimulus or an activator, reveals latent information. Typically the pattern is a uniform array of dots printed on a substrate. The latent information may be a function of the type dye used for various dots in the array, or may be a function of mask placed over the substrate, or the latent information may be a function of an application of a patterned activator. Typically the activator is an adhesive substance on a transparent overlaying film. However, in some embodiments of the invention, particularly tamper indicators, the activator is any substance used to attack the integrity of a seal to which a component of the pattern is sensitive. Upon placement of the stimulus or activator onto the substrate, a component of the pattern either coalesces or disappears to reveal the latent information.

A preferred embodiment of this invention is a self-expiring parking permit comprising a substrate of a construction that allows it to be hung from a rearview mirror, a pattern comprising migrating and non-immigrating components printed on the substrate containing latent information, and a transparent film having an adhesive surface. At the time of issuance of the permit, the transparent film is adhered to the substrate such that the adhesive surface contacts the pattern on the substrate and causes, over a specified time interval, the migrating components to coalesce to reveal the latent information contained within the pattern. Thus, the permit self-expires.

In another preferred embodiment, the patterned indicator is visitor's pass wherein numbers appear sequentially corresponding to passing time intervals.

In still another embodiment, the patterned indicator is a self-voiding bar code having a background pattern, which, after activation coalesces so that the bar code is no longer distinguishable.

In still another embodiment, the patterned indicator is a dynamic ticket which self-voids after the passage of a time interval.

In yet another embodiment, the patterned indicator is a wrist band ticket which self-expires after the passage of a time interval.

In yet another embodiment, the patterned indicator is a warning label or sign on which the warning message self-expires or disappears after the passage of a time interval.

Other preferred embodiments include:

- a self-expiring retail sticker applied to goods after a sale to indicate that the goods are sold, but which, upon expiration, is incapable of subsequent deceitful use;
- a self-expiring pharmaceutical label on which, after the passage of a time interval corresponding to the life of the pharmaceutical, the label indicates expiration;
- a dynamic price indicator label which initially shows one price, but after the passage of a time interval, cancels the original price and shows a reduced price; and
- a patterned indicator for notification of something that needs to be done after the passage of a time interval.

In an alternative embodiment the patterned indicator is tamper evident tape for sealing packages. The tape is printed on its top surface with a pattern containing latent information. Upon unauthorized attack by any of a number of means to the package seal, the latent information contained in the pattern is exposed, indicating that the package has been tampered with. This embodiment is also directed to a tamper evident patterned indicator formed as part of an envelope flap. Also, a variation of this embodiment is directed to a patterned tamper indicator for placement between leaves of a package, the effectiveness of this indicator being that it is not apparent to a tamperer.

DETAILED DESCRIPTION OF THE INVENTION

The present invention pertains to patterned indicators. In the preferred embodiments, the pattern comprises an array of ink dots. Hidden within the array of dots is latent information. The latent information may result from printing the dots in different inks, some dots being dissolvable or migrating and some being inert. In other embodiments, the array is printed only with one dissolvable ink but is masked with an inert film, the latent information thereby being a function of the pattern described through the inert film. The latent information is brought forth from the pattern through, in many embodiments, the application of a transparent adhesive film. Typically, contact with the adhesive surface of the film causes the ink dots to dissolve, migrate and coalesce. In other embodiments, the dye may be bleached clear by the adhesive. Further, in some embodiments, such as tamper indicating packaging tape, the activator is not part of the invention but is that which is used by one attempting to attack the package seal of a, e.g. heat, water or organic solvent. The latent information arising from such an attack indicates tampering.

The patterned indicator of the present invention has a number of highly preferred embodiments. Many, but not all, of these embodiments are depicted in FIGS. 1–38.

Figure 1:
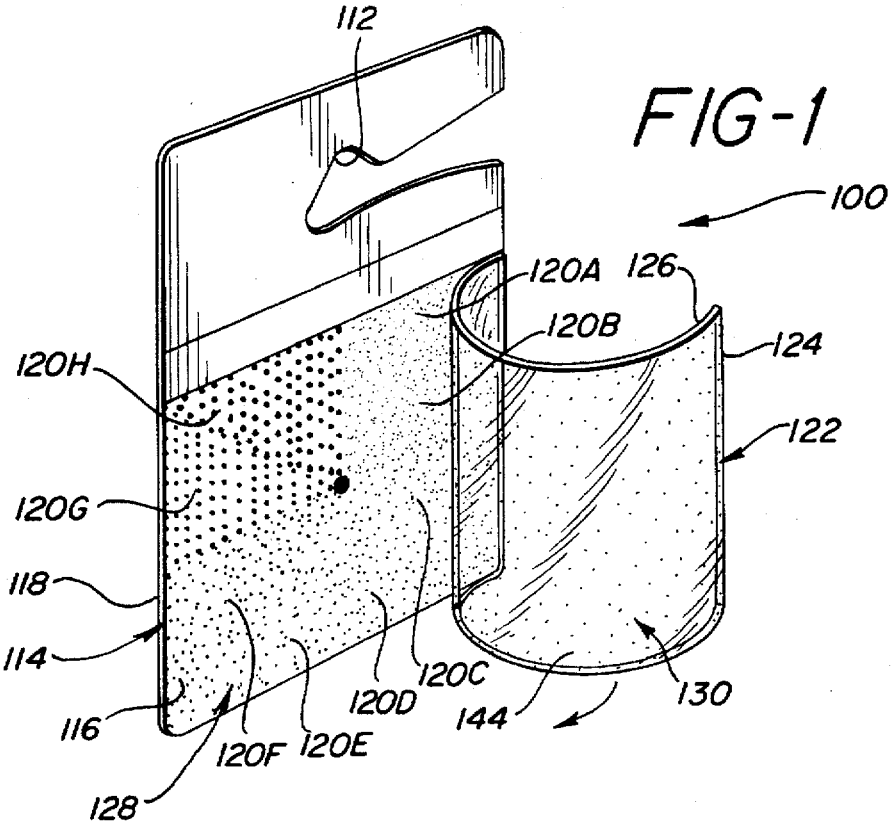
FIG. 1 is a perspective view of the parking time indicator of this invention being activated by applying a transparent substrate over the printed substrate.
Figure 2:
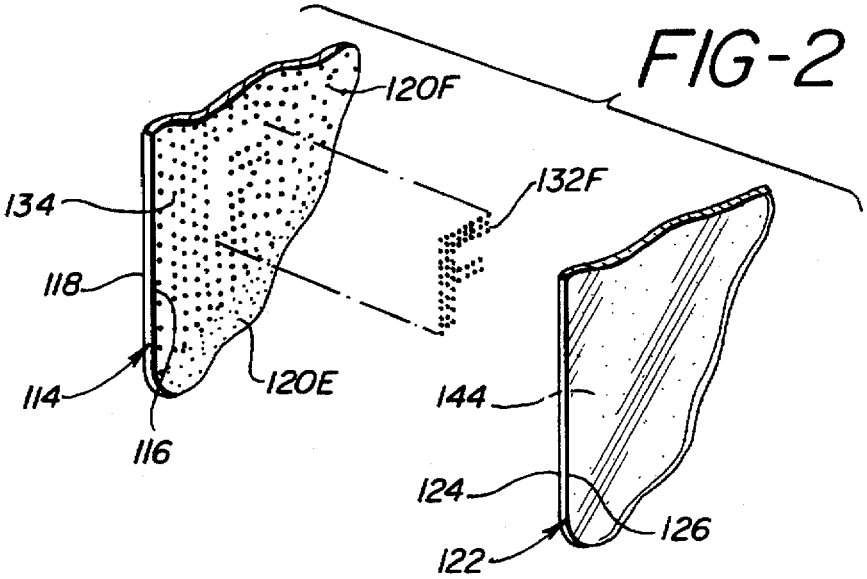
FIG. 2 is an exploded perspective view of a portion of the time indicator of FIG. 1 showing the first substrate, the dot pattern printing thereon, and the overlaying transparent substrate.
Figure 3:
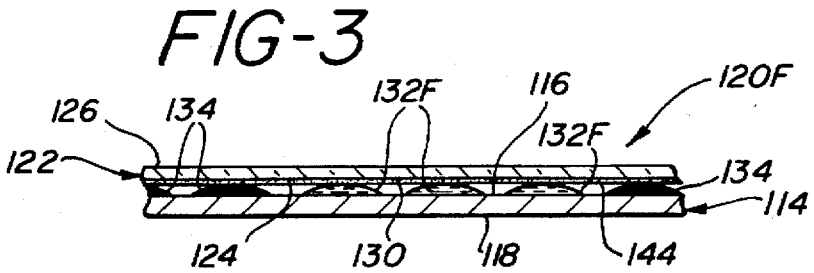
FIG. 3 is a schematic cross-sectional view of the time indicator of FIG. 1.
Figure 4:
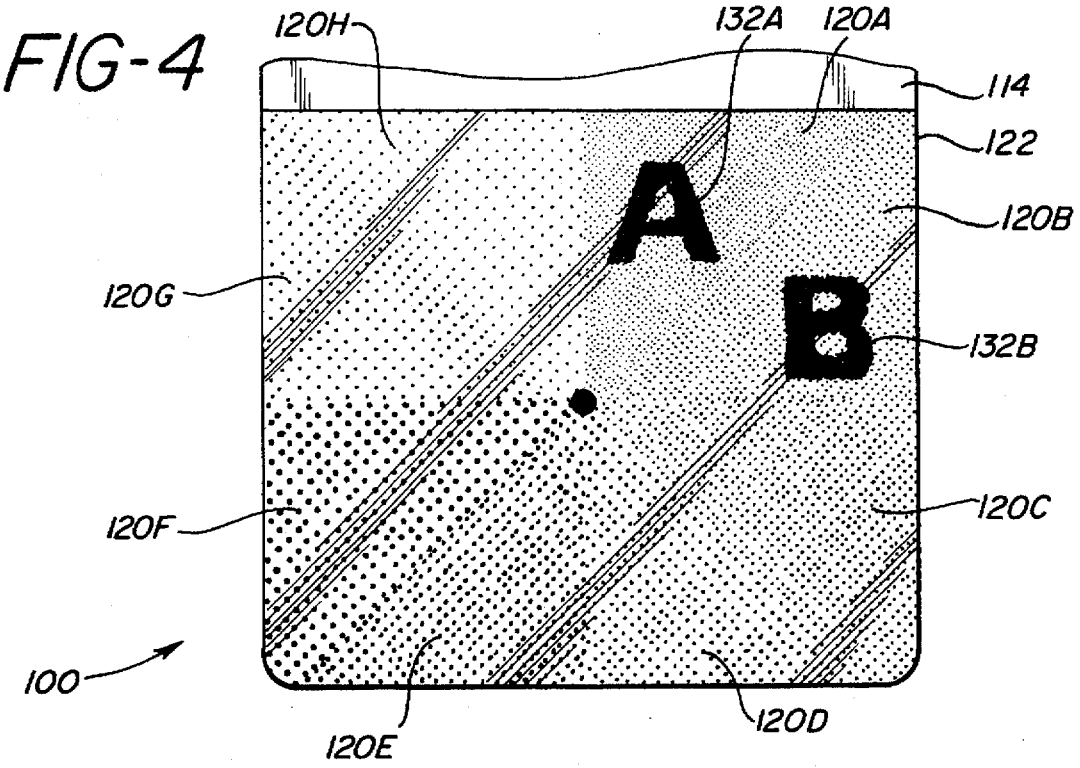
FIG. 4 is a partial front view of the time indicator of FIG. 1, shortly after activation.
Figure 5:
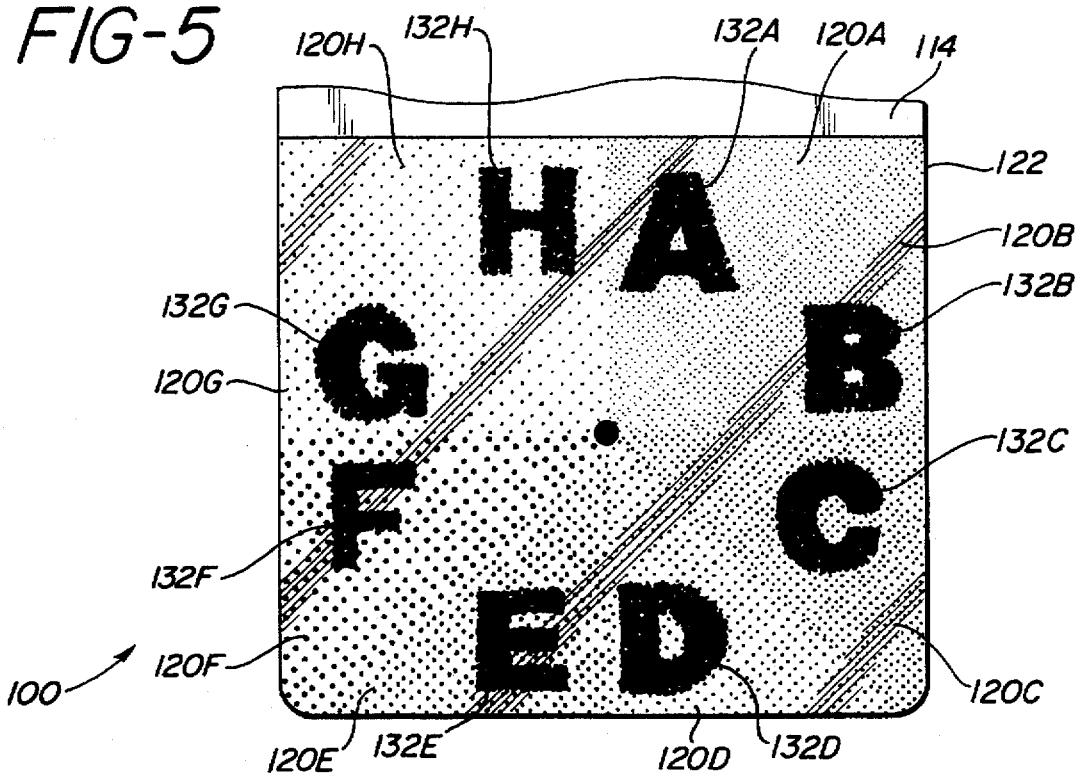
FIG. 5 is a partial front view of the time indicator of FIG. 4, after a longer period of time has elapsed.

The embodiment of this invention depicted in FIGS. 1–8 comprises a rectangular parking permit or parking time indicator, generally designated 100, which may be conveniently hung from, for example, the rearview mirror of the car by slot 112 therein. Referring to FIGS. 1–3, the indicator 100 is comprised of a first substrate 114 which has first and second surfaces 116,118. Substrate 114 may be made of cardboard, plastic, or any other material suitable for its intended use. Substrate 114 has thereon at least two indicia areas on the first surface. This invention, however, contemplates any number of indicia areas. As shown in FIGS. 1, 4 and 5,the parking permit depicted has eight adjacent triangular indicia areas 120A–120H arranged in a clockwise pattern. Each indicia area is designed to indicate the passage of approximately an hour of time.

Still referring to FIGS. 1–3, a second substrate 122 is provided which has first and second surfaces 124,126. In general, a first chemical agent 128 is applied on each indicia area and a second chemical agent 130 is applied on the first surface 124 of the second substrate 122. When the first surfaces 116, 124 of each substrate 114,122 overlay and are in contact with each other, the first and second chemical agents 128,130 coact to cause a visually perceptible change at one of the second surfaces 126 overlaying the first indicia area, e.g. 120A, in a first selected time interval, e.g. one hour, and a visually perceptible change in the second surface 126 overlaying the second indicia area 120B in a second selected time interval, e.g. two hours, the first selected time interval differing from the second selected time interval.

In the parking permit depicted in FIGS. 1–7, there are eight indicia areas 120A–120H. Each indicia area changes, sequentially, in a clockwise pattern, to depict the letters A, B, C, D, E, F, G and H, for example, an hour after the previous indicia area has depicted its respective letter. In effect the selected time interval for indicia 120A is one hour, 120B is two hours, 120C is three hours, etc.

In the preferred embodiments depicted herein the second substrate 122 is transparent. It should be understood however that the coaction of the agents 128, 130 can, for example, produce a bleeding of color through the second substrate, thus obviating the need for transparent substrate.

Referring to FIGS. 1–7, an ink pattern is provided on each of the indicia areas 120A–120H. This ink pattern may be a pattern of dots 132A–132H printed in a preselected pattern in each of the indicia areas. The use of the term "dot" includes not only the usual meaning of the word dot, i.e., a small round point, but also other type small points of ink print, for example triangular, heart shaped, etc.

Figure 8:
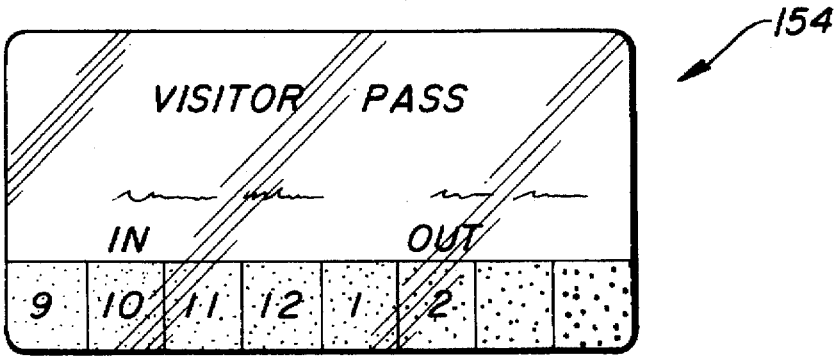
FIG. 8 is a front view of another embodiment of the time indicator of this invention.
Figure 9:
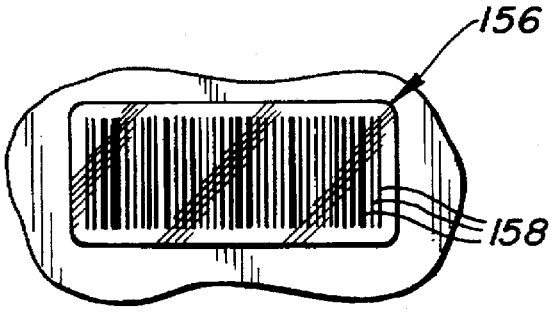
FIG. 9 is a fragmentary view of a bar code time indicator of this invention shortly after activation.

As indicated in FIG. 5, the ink pattern is an A, B, C, D, E, F, G and H, in FIG. 8 it is a number indicating time, e.g. 10, 11, etc., and in FIG. 9 it is a series of bars producing a bar code.

As shown in FIG. 2 and FIG. 3, the indicia 120F may have an ink pattern 132F which is surrounded by a pattern of background dots 134, preferably of the same color as ink pattern 132F, which do not develop or change over a period of time. Ink pattern 132F is preferably a soluble ink pattern which, when placed in contact with the adhesive 144 which includes a solvent for the soluble ink, dissolves the dots so that the dots of the pattern bleed into each other. The background dots 134 are printed with an insoluble ink and thus they do not bleed together when in contact with the adhesive.

In general, it is the combination or coaction of the first and second chemical agents 128, 130 that produces the indication of time and this may be accomplished by either varying the chemical agent and/or pattern on the second substrate 122 and/or on the first substrate 124. Thus, this invention also contemplates that the second chemical agent 130 on the second substrate 122 may be imprinted in such a manner that it dissolves only portions of the dot pattern imprinted on substrate 114.

Figure 6:
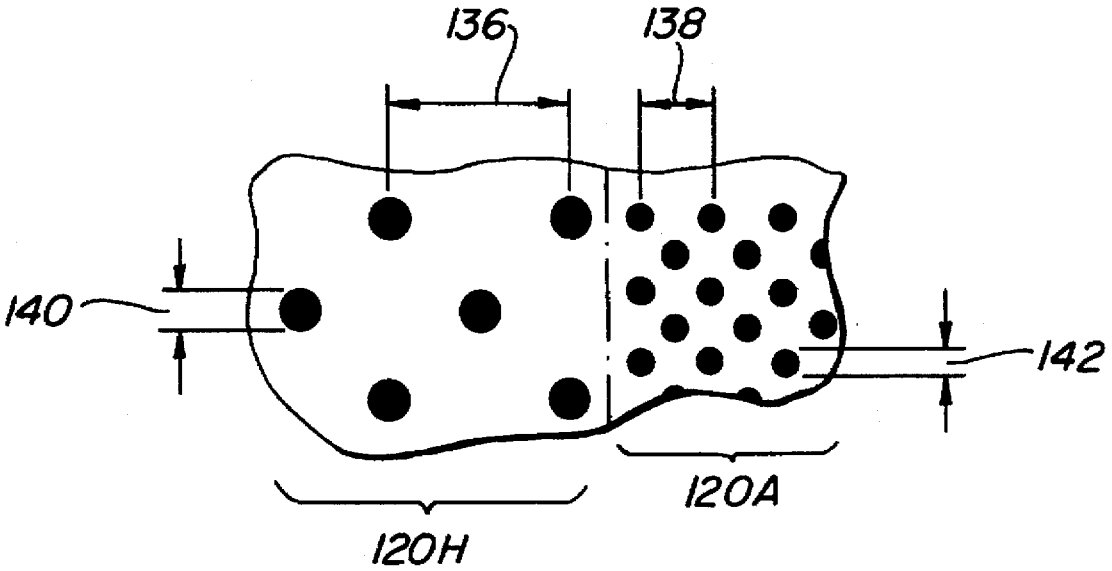
FIG. 6 is an enlarged detailed view of the time indicator of FIG. 1, showing the relationship, size and spacing of dots of the dot patterns.
Figure 7:
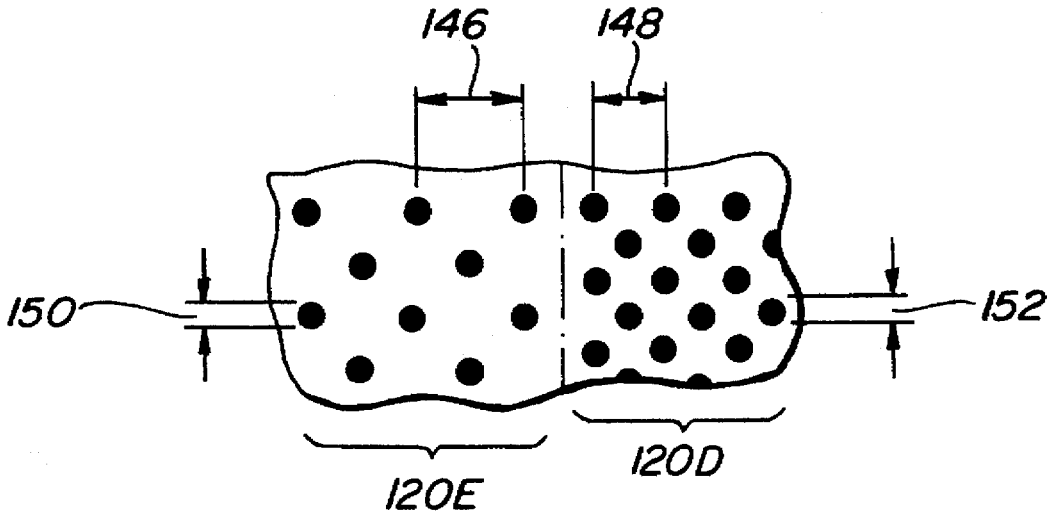
FIG. 7 is a view similar to FIG. 6, showing an alternate embodiment of the relationship, size and spacing of dots of the dot patterns.

An important aspect of this invention is that the use of a dot pattern imprinted on the first substrate makes it simple to vary the preselected time of development of each indicia area by varying the shape and size of the dots and/or varying the dot-to-dot linear dimension. This variation of shape and size and dot-to-dot linear dimensions is seen in a macroscopic view in FIGS. 1, 4 and 5 and on a relatively microscopic view in FIGS. 6 and 7. For example, referring to FIG. 6, depicting indicia area 120A adjacent to indicia area 120H, the dots in 20A are smaller and spaced closer together than 120H, i.e., the dot-to-dot distance 136 is greater than 38 and the dot diameter 140 is greater than 142. Alternatively, as shown in FIG. 7, depicting adjacent areas 120E and 120D, the dot-to-dot distance 146 is greater than 148 and the dot diameters 150, 152 are the same. Thus one can achieve varying preselected times by varying the geometric shape and size of the dots and/or the dot-to-dot distance. Depending on the application and times required, one can maintain the same geometric shape and size and vary the dot-to-dot distance of the patterns on indicia areas or keep the dot-to-dot linear distance the same and vary the geometric size and shape and/or vary both of these.

Referring to FIGS. 1–7, the indicia areas 120A–120H having dot patterns of different densities of colored migrating or soluble ink are printed on the permit in a clock face pattern. The dot "density" is most dense at the 112 to 1 o'clock indicia area 120A and progressively decreases in density in a clockwise manner.

In the preferred embodiment of the time indicator parking permit depicted in FIGS. 1–7, the first substrate 124 is made of cardboard or heavy paper which is cut to a shape that permits it to be hung from the rearview mirror of the vehicle, by, for example, slot 112. This type of attachment means insures that the permit is always in the same location in the vehicle independent of the type of vehicle and that the permit is not touching any surfaces, such as the windshield or the dashboard. The suspended permit experiences only ambient air temperature which is substantially cooler in summer and hotter in winter than the body or surface of the vehicle.

In use, the parking attendant issuing this parking permit 100 simply places the clear self-adhesive film 122 over the face of the printed substrate 114. This "activates" the indicator. As time passes, colored indicia develop, e.g. A, B, C, etc., beginning at, say 12 o'clock on the face and progress clockwise around the indicator as time progresses. A parking attendant can easily see which tags have expired and which are still valid simply by noting what most of the indicators show at the particular time he inspects the parking area.

Because the color change will be accelerated or suppressed depending on the ambient temperature, the parking attendant will use a relative comparison of all the tags in the area rather than any individual tag. This permits him to compensate for hot or cold days and thus use the same tag all year around. Of course, a transparent substrate having a different composition of adhesive and/or a different printed substrate may be used to compensate for temperature.

Depending on the rate of dissolution of the migrating ink by the adhesive on the cover film, the parking permits could be used for a few hours, a day, a week, etc. In each case the relative darkening of the indicator bands on the printed face of the parking tag would show the relative elapsed time since issuing the parking permit. The "clock" on the face of the permit can be seen from 10 to 20 feet away, darkened expired tags cannot be reused and it is difficult to print counterfeit permits.

Substrate 114 can be a continuous pin feed tag made of heavy paper stock, which may be computer-printed, written on directly by hand or left blank. To use, simply fill in the necessary information (expiration date, time, license number) and apply the clear activating cover 122 over the shaded clock. The clock will slowly become dark in stages showing expiration. Preferably there is a one-day and one-month activating cover. Such parking permits may be custom printed for use.

Based on the properties of the adhesive, dyes or inks and dot "density" used, the rate of color change or "dot growth" can be very accurately controlled. In all the embodiments depicted herein, all dots, i.e., the soluble and insoluble background dots, are printed with a black ink. Thus, anyone looking at the patterns cannot see the information contained in the soluble dotted array. This hidden or subliminal information is decoded, developed, or made visible by placing the second substrate over the dot pattern to cause the inks to behave differently. In this case the migrating ink begins to bleed into the adhesive on the rear surface of the film, causing the dots to grow. As each dot grows, it literally changes the dot density, hence making that portion of the printing darker and visible.

By using different dot patterns and dot densities, one can compensate for temperature variation so that different time-temperatures will show a progressive display pattern, while a specific time at only one temperature or within a limited temperature range will show a uniform and specific change with time only. Hence these can be true time indicators or time indicators which compensate for temperature variations or time temperature indicators.

FIG. 8 shows an embodiment of the time indicator of this invention in the form of a visitor pass 154. After activation of the pass by applying a transparent film, the numbers 9, 10, 11, 12, etc. appear in sequence, indicating the hours elapsed since activation. As with the parking ticket, the latent information containing within the pattern may be a function of a coaction between soluble and insoluble inks, a mask having a pattern described therethrough, or a patterned adhesive on the underside of the transparent film.

Figure 10:
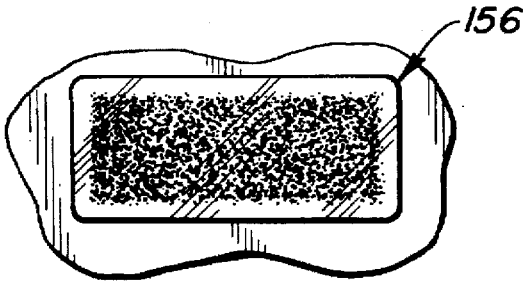
FIG. 10 is a fragmentary view of the bar code time indicator of FIG. 9 after expiration.

FIGS. 9 and 10 show another embodiment of this invention in the form of a bar code 156, for example on a ticket. The bars 158 are imprinted, for example in a dot pattern and after activation by applying the transparent substrate gradually bleed together indicating a void bar code. As with the parking ticket, the latent information containing within the pattern may be a function of a coaction between soluble and insoluble inks, a mask having a pattern described therethrough, or a patterned adhesive on the underside of the transparent film.

Figure 11:
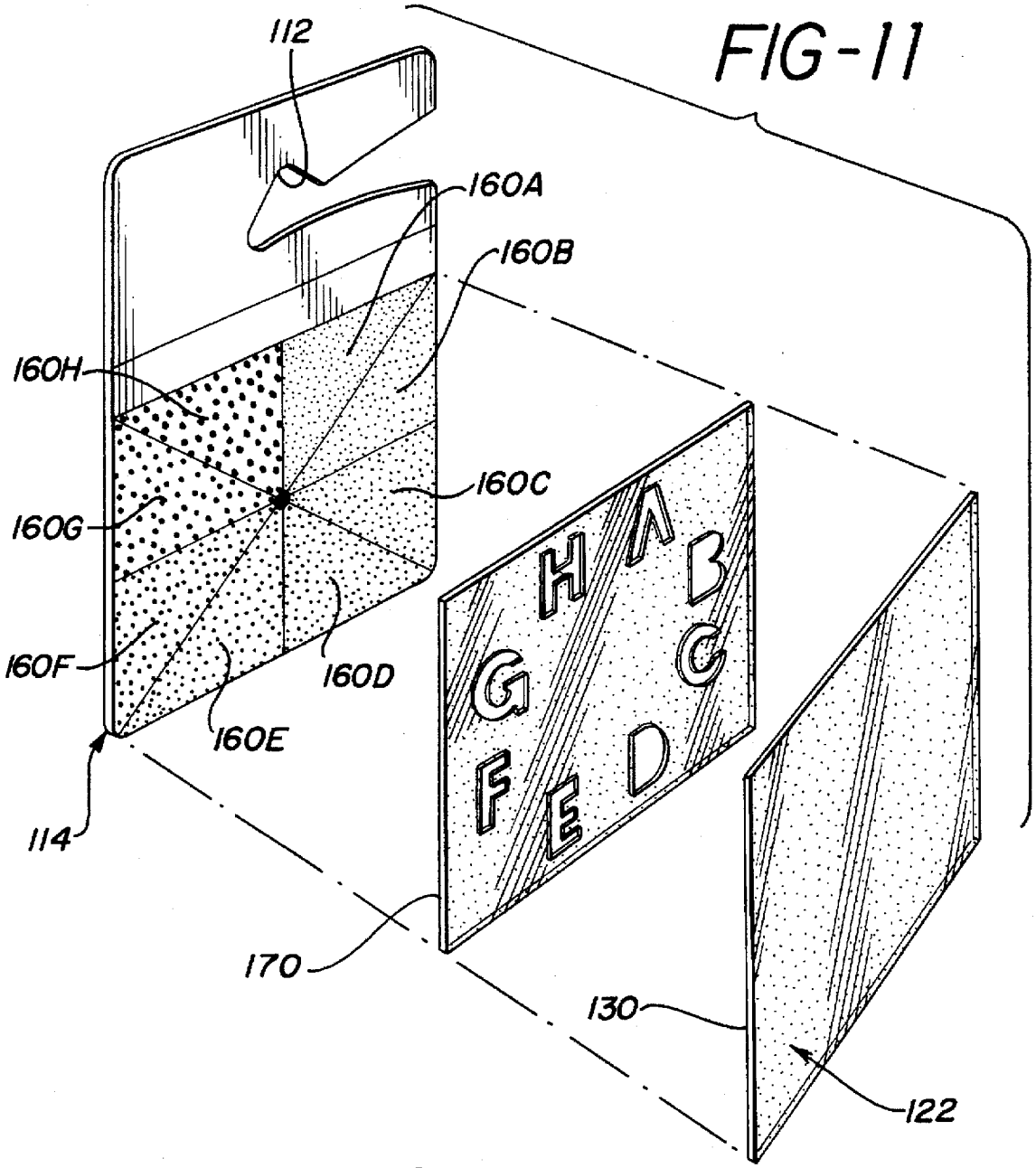
FIG. 11 is a perspective view of an alternative embodiment of the parking time permit.
Figure 12:
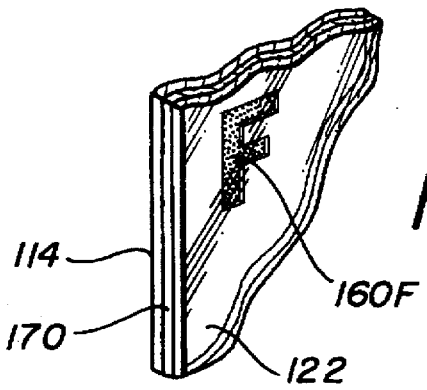
FIG. 12 is a fragmentary view of the parking time permit of FIG. 11 after activation.

In an alternative embodiment of the self-expiring parking permit, shown in FIGS. 11 and 12, the first substrate 114 can be printed entirely with a pattern of soluble ink dots and covered with a mask 170 having a pattern described therethrough. This parking permit operates similarly to the embodiment of FIGS. 1–7, except that the latent information is a function of the pattern described through the mask. In this embodiment, only portions of the pattern on the first substrate 114 are in contact with the adhesive activator 130 on the second substrate or transparent film 122, and only those dots in contact with the activator are able to coalesce to expose latent information. Thus, the latent information is a function of a pattern described through the mask 170. FIG. 12 is a fragmentary view of indicia area 160F showing the latent information contained therein.

Alternatively, the transparent film 122 may have a pattern of adhesive on its underside (not shown). Thus, the patterned activator on the transparent film contacts only portions of the pattern, and the latent information is a function of the adhesive pattern on the transparent film. Either embodiment of the patterned indicator, printing entirely of soluble dots is useful in overcoming the problems associated with dot color, registration and uniformity in connection with the use of two or more different inks.

Figure 13:
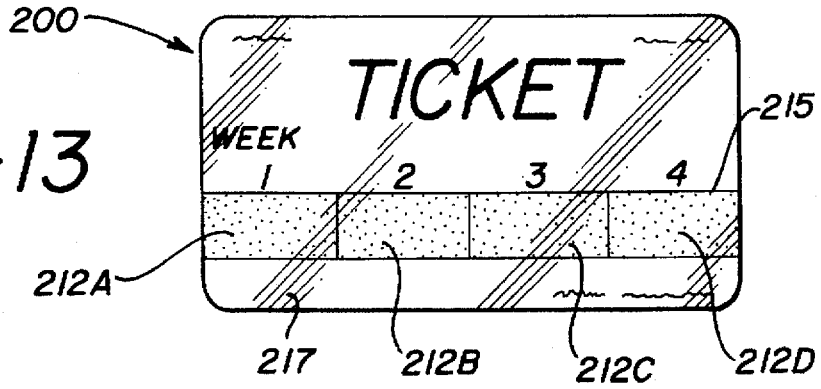
FIG. 13 is a front view of a ticket using an embodiment of this invention.
Figure 14:
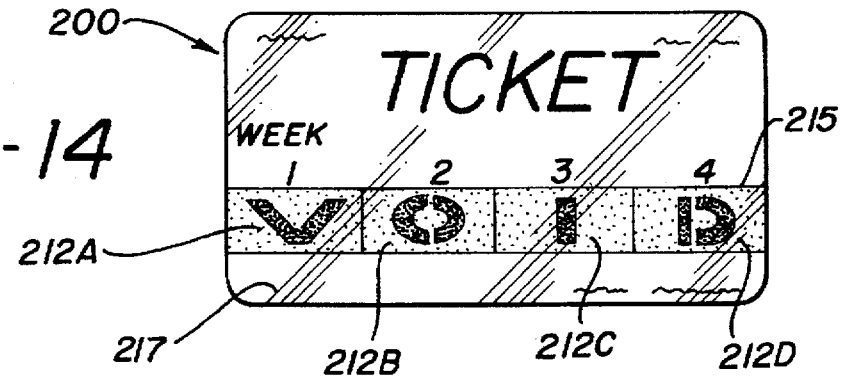
FIG. 14 is a front view of the ticket of FIG. 12 after the elapse of a predetermined period of time.
Figure 15:
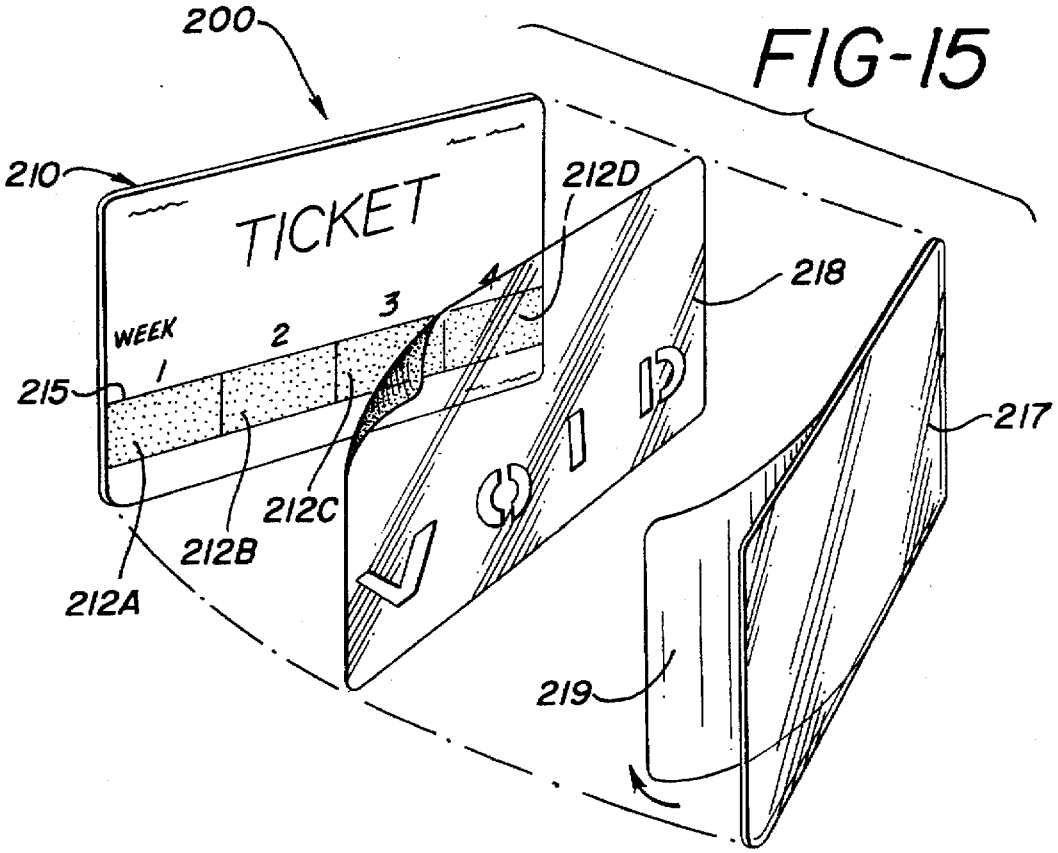
FIG. 15 is an exploded perspective view of the ticket of FIG. 12.

In a preferred embodiment, FIGS. 13, 14 and 15, the patterned indicator is a dynamic ticket 200 is provided. The dynamic ticket 200 comprises a substrate 210 containing one or more indicia area 212A, 212B, 212C, and 212D indicating, respectively, different time intervals. On each indicia area is printed a pattern, typically an array of dots. On issuance, an adhesive transparent film 217 is placed over the entire ticket 200. The adhesive on the underside of transparent film 217 is the stimulus which causes some of the individual dots 215 comprising the patterns to coalesce, thus revealing the latent information within each indicia area. The patterns in the different indicia areas produce the latent information contained therein in different preselected time intervals because of variations in either the dye comprising the dots, the spacing of the dots, the size of the dots, or the acidity of the adhesive.

In the preferred embodiment shown in FIG. 15 the latent information contained on the dynamic ticket 200 is a function of a pattern described through a mask 218. The mask 218 is a thin, transparent film typically laminated to substrate 210. The mask 118 prevents the adhesive on transparent film 117 from contacting parts of the pattern which it overlays. The parts of the pattern which are contacted by the adhesive are activated to reveal latent information. Typically the pattern comprises an array of dots. The dots activated by the adhesive are dissolved and migrate or coalesce to expose the latent information. In other embodiments, however, the pattern 214 may be bleached by the adhesive, or the pattern may go through a color change to reveal the latent information.

The dynamic ticket 200 typically includes the adhesive transparent film 217 fastened to one side of substrate 210. The adhesive transparent film 217 is provided with a liner 219 to prevent premature activation of the ticket. At issuance, the liner 219 is peeled from the transparent 217, to expose the adhesive. The transparent film 217 is then placed over substrate 210 to begin activation of the ticket. The adhesive maintains the transparent film 217 in adhesive contact with the substrate 210. The adhesive is strong enough to prevent removal of the transparent film 217 from the substrate 210.

The dynamic ticket 200, in a highly preferred embodiment, is a monthly transit ticket. As shown in FIGS. 13, 14, and 15, the monthly transit ticket has four indicia areas 212A, 212B, 212C, and 212D thereon, each indicia area representing a week. At the end of week one, section one 212A is self-expired; at the end of week two, section two 212B is self-expired; at the end of week three, section three 212C is self-expired; and at the end of week four, the entire ticket 200 is expired. In the preferred embodiment, the latent information contained in the sections 212A, 212B, 212C, and 212D is one letter of the word "void", so that after one month the ticket reads "void". While the dynamic ticket is important for indicating the passage of time, its true value lies in its inability to be easily counterfeited because of the progressive change which occurs.

Figure 16:
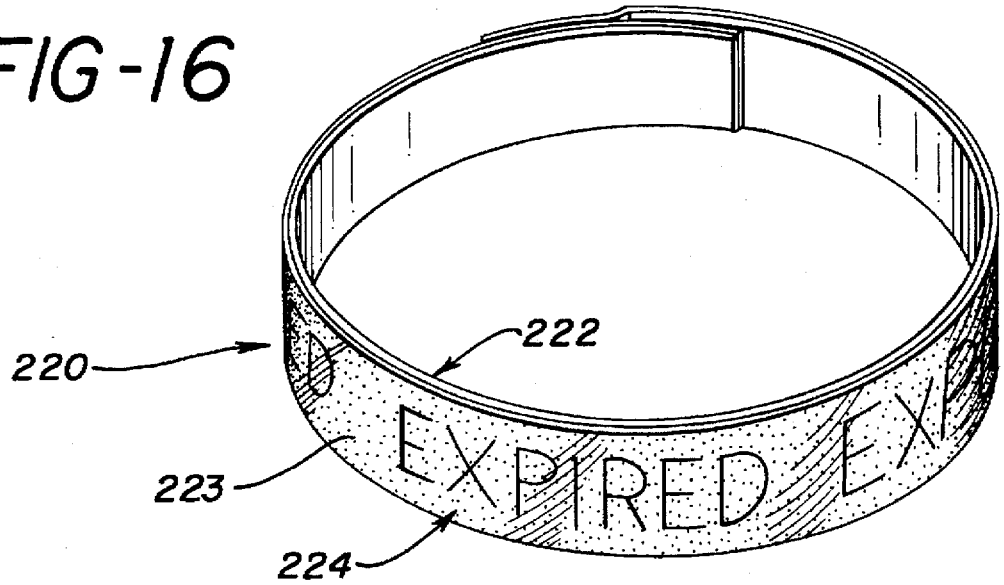
FIG. 16 is a perspective view of a wrist band ticket of this invention after expiration of a predetermined period of time.
Figure 17:
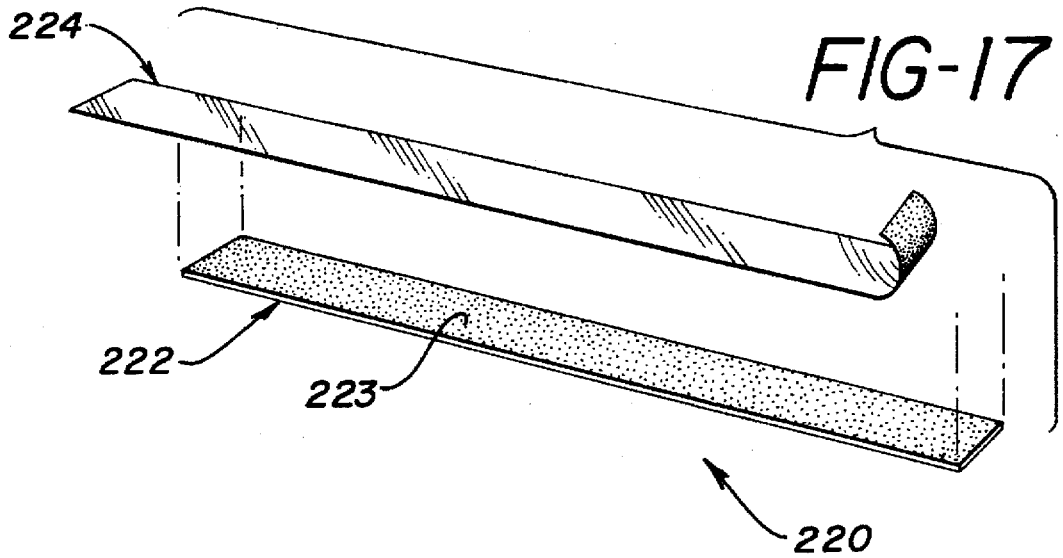
FIG. 17 is a perspective view of the construction of the wrist band ticket of FIG. 15.
Figure 18:
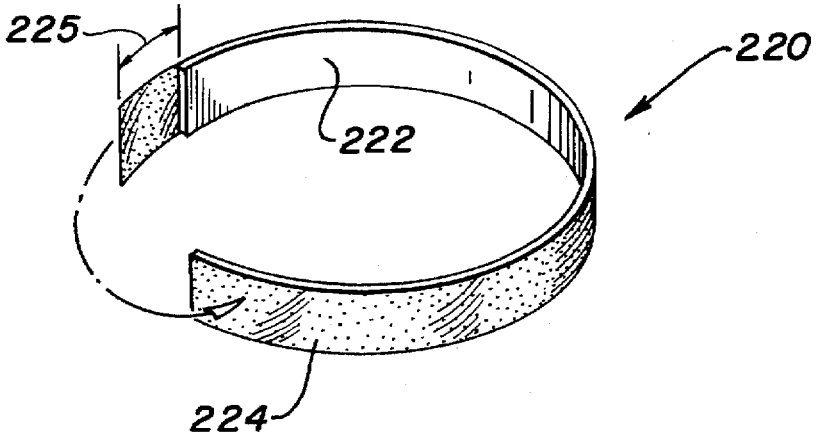
FIG. 18 is a perspective view of the wrist band ticket of FIGS. 16 and 17 to be placed on the user, e.g. attendee to an event.

The wrist band ticket, another preferred embodiment of the patterned indication of this invention, is depicted in FIGS. 16, 17 and 18. It is indicated generally at 220, and comprises an elongated flexible substrate 222 having a pattern 223 thereon and transparent film 224. Typically the pattern 223 is an uniform array of dots. The pattern 223 may be printed of soluble and insoluble inks, the soluble ink dots arranged to contain latent information. Alternatively, the pattern 223 may be printed of soluble ink only and a mask having a pattern described therethrough placed over the pattern, the latent information thus being a function of the pattern described through the mask. The transparent film 224 is anchored at one end to substrate 222 and extends a short distance beyond the other end. The transparent film 224 has an adhesive coated underside, which is covered by a liner (not shown) prior to use.

Upon purchase of the wrist band 220, the liner on the transparent film 224 is removed to expose the adhesive underside of the transparent film 224. The transparent film 224 is then placed in adhesive contact with the substrate 222. The wrist band 220 is fastened around the wrist of the purchaser; the length 225 of the adhesive film 224 extending past the substrate 222 is used to secure the ends of the substrate together around the purchaser's wrist. The latent information contained in the pattern on the wrist band 220 is brought forth through either dot coalescence or bleaching, usually in the time period of one day, resulting in, typically, the word "expired" being visible along the circumference of the wrist band 220. See FIG. 16. The self-expired wrist band ticket is thus incapable of being transferred for subsequent use at a subsequent time.

Figure 19:
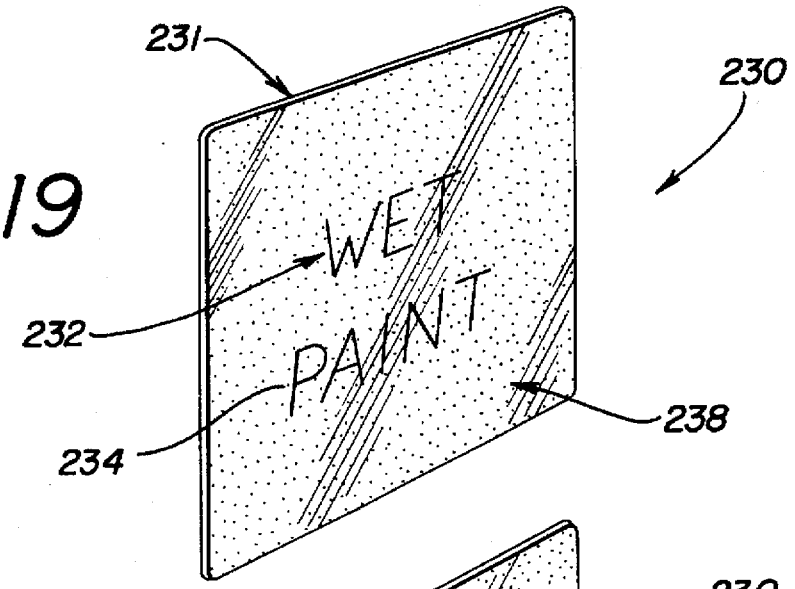
FIG. 19 depicts a warning sign utilizing an embodiment of this invention.
Figure 20:
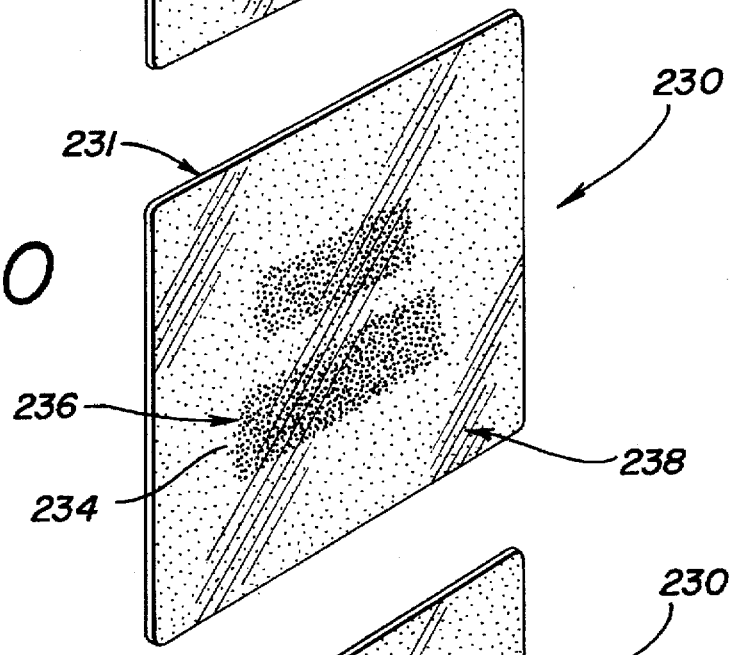
FIG. 20 shows the warning sign of FIG. 18 after a period of time with the warning message blackened out.
Figure 21:
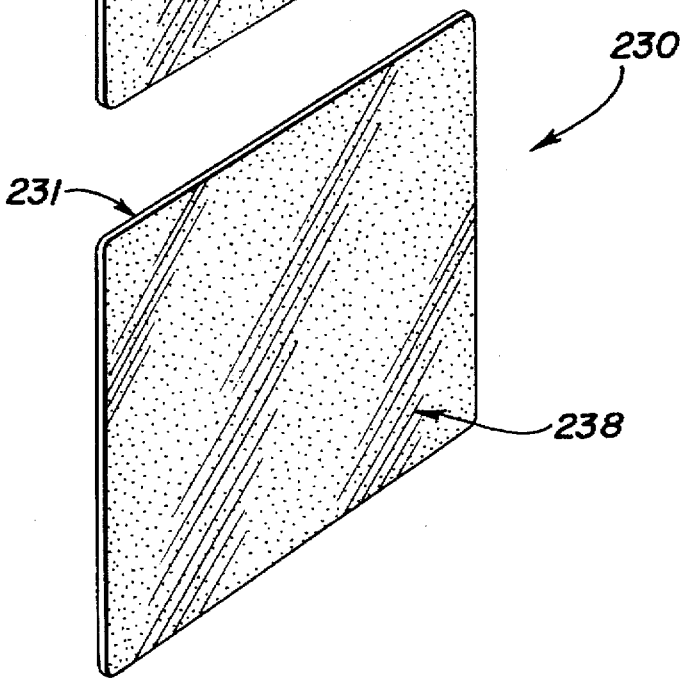
FIG. 21 shows the warning sign of FIG. 18 after a period of time with the warning message bleached.

In FIGS. 19, 20, and 21 a warning label or sign, indicated generally as 230, is depicted. The warning sign 230 has a substrate 231 with a warning message 232 printed thereon. Typically, the warning message 232 is important for a particular time interval. For instance, a "wet paint" sign is important only for the time period before the paint dries. The patterned indicator of the present embodiment provides for the self-expiration of such warning signs.

Shown in FIG. 20 is a self-expired embodiment of the sign of FIG. 19, wherein the self-expiration arose from the darkening of a pattern 234 surrounding the warning message 232 to provide a block 236 which conceals the warning message 232. The block 236 results from, typically, the coalescence of the pattern 234 surrounding the warning message 232. The coalescence of the pattern is activated by an adhesive on the underside of transparent film 238.

In an alternative embodiment, FIG. 21, the warning message 232 of the warning sign 230, is bleached and disappears after a period of time. The bleaching results from the interaction of the adhesive underside of transparent film 238 with an organic soluble ink comprising the warning message 232.

Figure 22A:
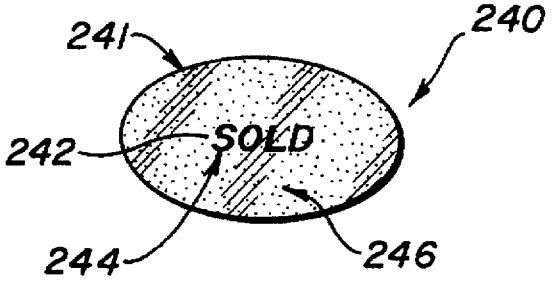
FIGS. 22A and 22B depict an embodiment of the invention directed to a retail label applied to goods, prior to and after the expiration of a period of time.
Figure 22B:
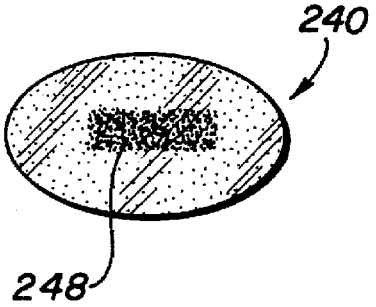

In another preferred embodiment of the patterned indicator, FIGS. 22A and 22B, a self-expiring retail sales sticker 240 is provided. The self-expiring retail sales sticker 140 shown in FIG. 22A is placed on a package at the point of sale. It comprises a substrate 241 having a pattern 242 and a message 244 printed thereon and a transparent film 246 having an adhesive surface for overlaying on the substrate 241. The adhesive surface of the transparent film 246 is put into adhesive contact with the pattern when the sticker 240 is issued. The adhesive activates the pattern 242 and brings forth latent information contained within the pattern. The latent information may be a function of different inks with which the pattern is printed, or of a mask. Typically the latent information is brought forth through coalescence of the pattern, and with reference to FIG. 22B, typically the latent information is a block 248 surrounding the message which, upon activation darkens the background of the message to block out the message. Thus, after a period of time, preferably a day, the word "sold" is no longer visible, FIG. 22. Alternatively, the retail sales sticker may self-expire through the bleaching of the message (not shown). Thus, the self-expired retail sticker 240 is not reusable on subsequent days.

Figure 23:
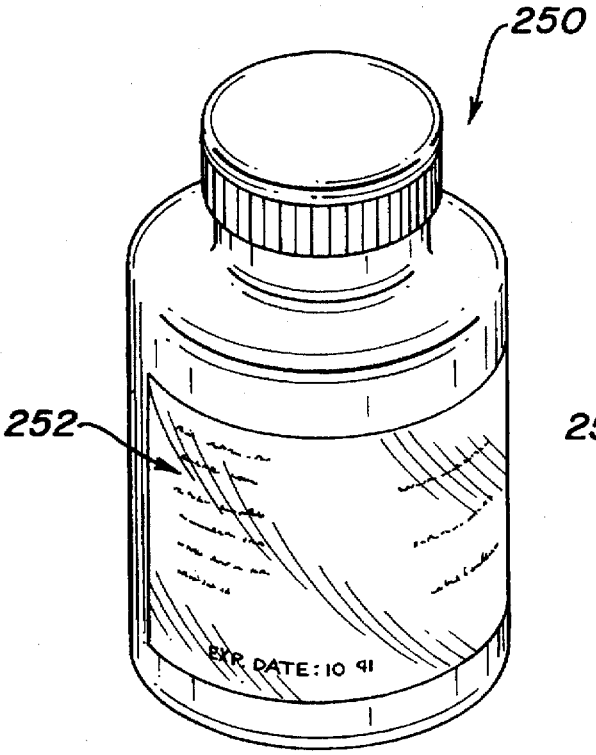
FIGS. 23 and 24 depict another embodiment of the invention which includes the expiration date label on a pharmaceutical container, prior to and after expiration of the indicated date.
Figure 24:
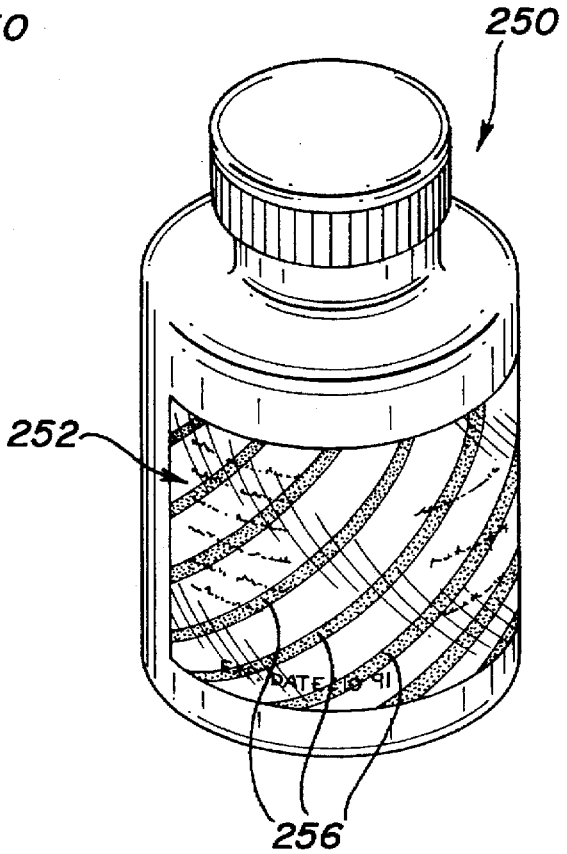

FIGS. 23 and 24, illustrative of another embodiment of a patterned indicator, show a pharmaceutical container 250 having a self-expiring label 252 thereon. The date of self-expiration of the label 252 corresponds to of expiration date of the contents of the pharmaceutical container. The self-expiring label 252 comprises a substrate on which is printed the typical information contained on such labels, and also on which is printed a pattern having latent information contained therein. The latent information is brought forth by the application of an adhesive activator residing on the underside of a transparent film 254. The application of the adhesive activator takes place after a placement of the pharmaceutical products in container 250. The latent information, in one embodiment, results from the dissolving of soluble ink in a pattern comprising soluble and insoluble ink, and in another embodiment, from soluble ink exposed through a mask (not shown) placed over the pattern.

In the preferred embodiment, FIG. 24, the latent information is a plurality of angled stripes 256, arranged across the face of label 252. In an alternative embodiment (not shown) the patterned background of label 252 turns color to highlight the passage of time and attract attention to the expiration of the useful life of the pharmaceutical products.

Figure 25A:
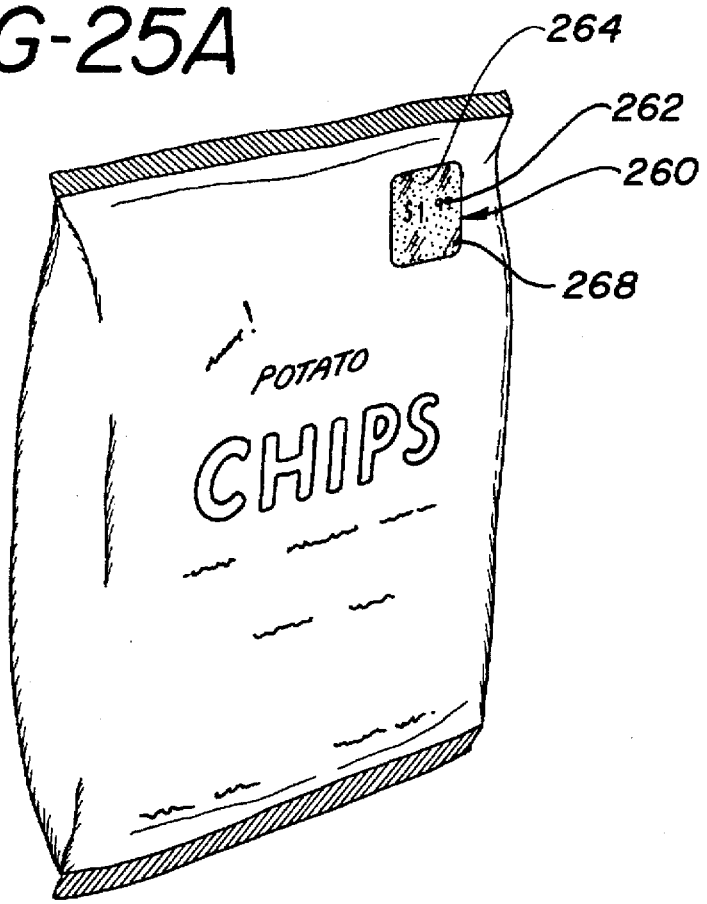
FIGS. 25A and 25B depict a price label embodiment of the invention, prior to and after expiration of a period of time.
Figure 25B:
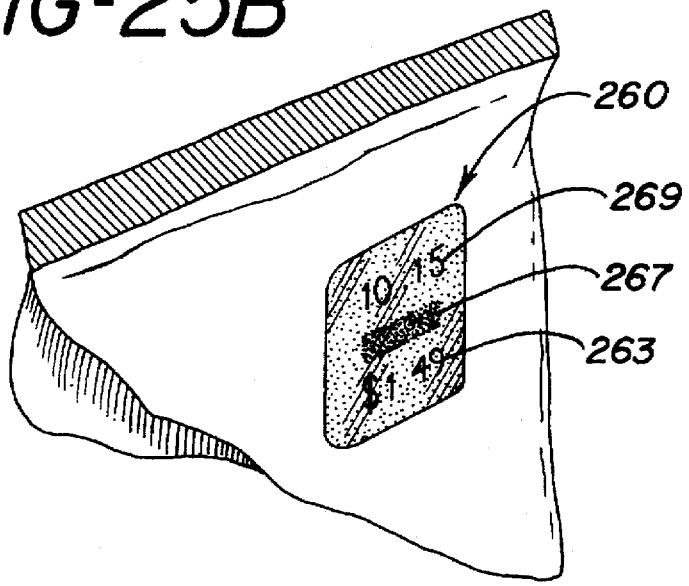

FIGS. 25A and 25B show another embodiment of the patterned indicator for use with retail goods. In this embodiment, the patterned indicator is a dynamic price tag 260. The dynamic price tag 260 comprises a substrate having information, such as a price 262, printed thereon, and a pattern 264 also printed thereon. Typically the pattern 264 is a uniform array of dots. The pattern contains latent information 266 which is brought forth through the process of dissolving portions of the pattern 264 and a coalescing of the inks.

The latent information results from the use of two different inks—a soluble ink and an insoluble ink—or alternatively, the latent information 266 is contained in a transparent mask which is applied over the pattern. This latent information is brought forth by an adhesive on the underside of a transparent film 268 which is placed over said substrate upon the finalization of the manufacture of the product. In the preferred embodiment, FIG. 25B, the latent information comprises the date 269 of expiration of the life of the product, the cancellation of the original price 262 by the darkening 267 of its background, and a new, reduced price 263.

Figure 26A:
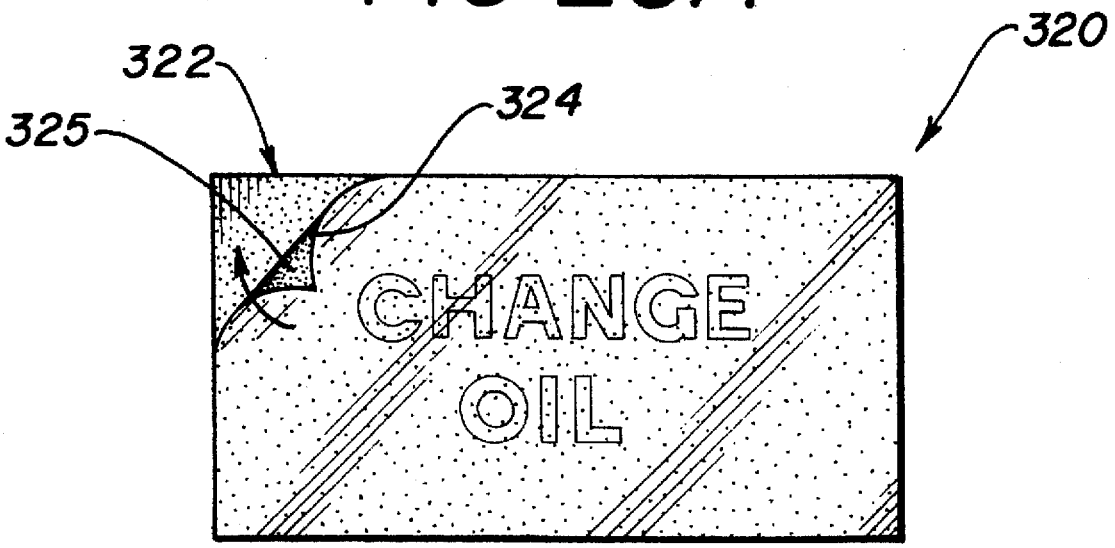
FIGS. 26A and 26B depict an embodiment of the invention comprising a time passage indicator for indicating that oil should be changed.
Figure 26B:
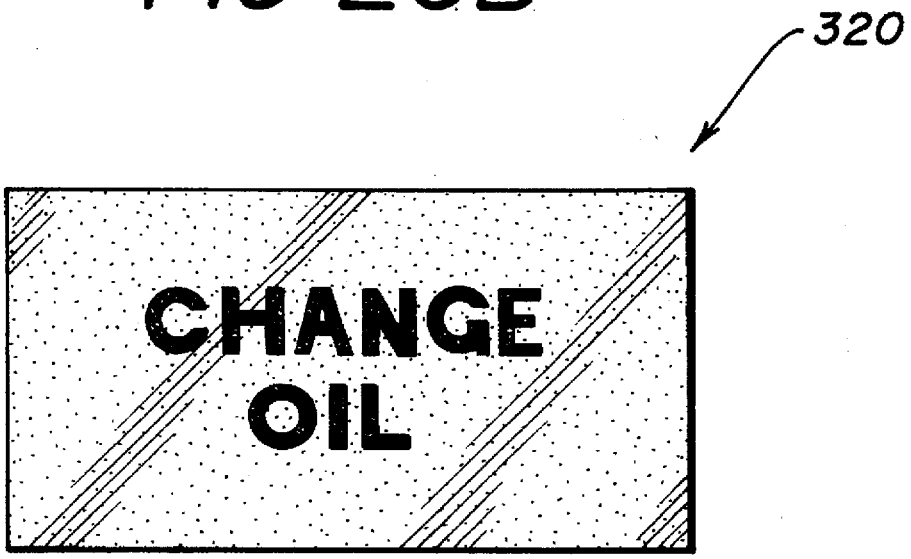

Depicted in FIGS. 26A and 26B is an embodiment of the invention in which the latent information of the indicator alerts someone to perform a task. Typically, the task must be periodically performed, e.g., changing the oil in a car engine. This indicator could also be used to indicate that replacement of a part is needed, or that calibration is required. The indicator 320 of this embodiment comprises a substrate 322 having a pattern printed thereon, and an adhesive, transparent film 324. The indicator 320 is activated by placement of the adhesive transparent film 324 into adhesive contact with the substrate. Typically the pattern is a uniform array of dots. The adhesive underside 325 of the adhesive transparent film 324 is the activator for bringing forth the latent information. The latent information may be hidden within pattern as a soluble ink component, or the pattern may be entirely of a soluble ink, and latent information may be a function of a pattern described through a mask (not shown) placed over the pattern. The activator dissolves the soluble inks that it contacts, causing the ink to spread out and coalesce. Thus, the latent information is made visible.

As shown in FIG. 26B, the latent information could be "change oil". Typically, the indicator 320 would be activated after completion of the task to alert one of the next time that the task has to be performed. The time interval needed for the latent information to become visible can be adjusted through various means including: varying the size of the dots, the dot-to-dot distance, the soluble ink component of the dots, and the acidity of the activator.

Figure 27A:
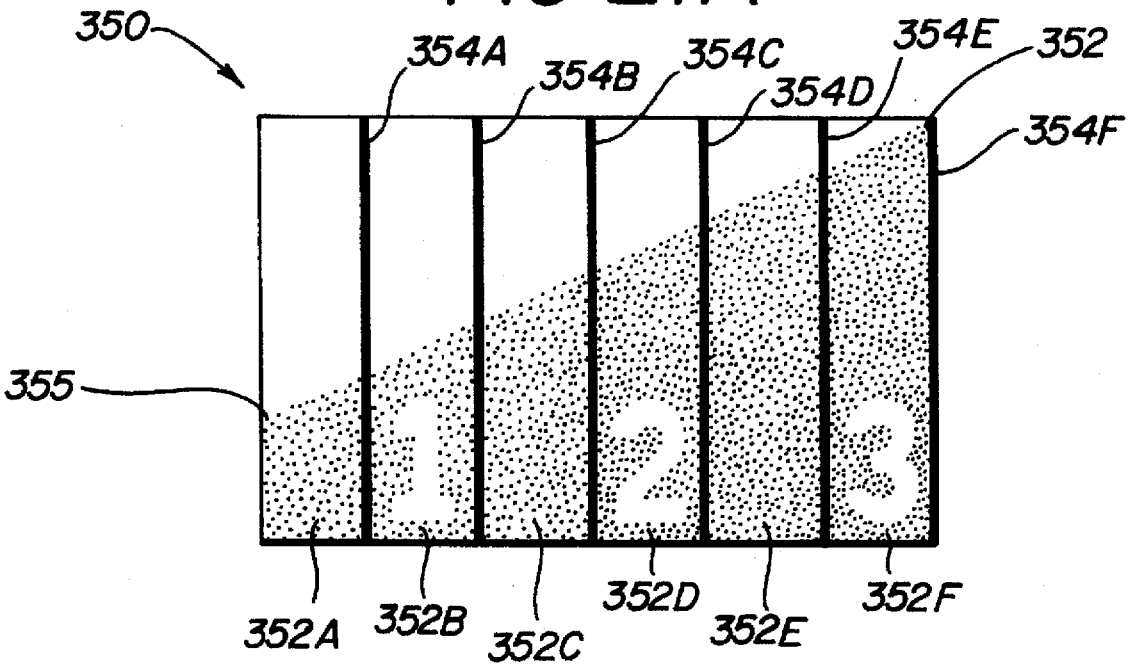
FIGS. 27A and 27B show a three month time indicator in unexpired and expired stages, respectively.
Figure 27B:
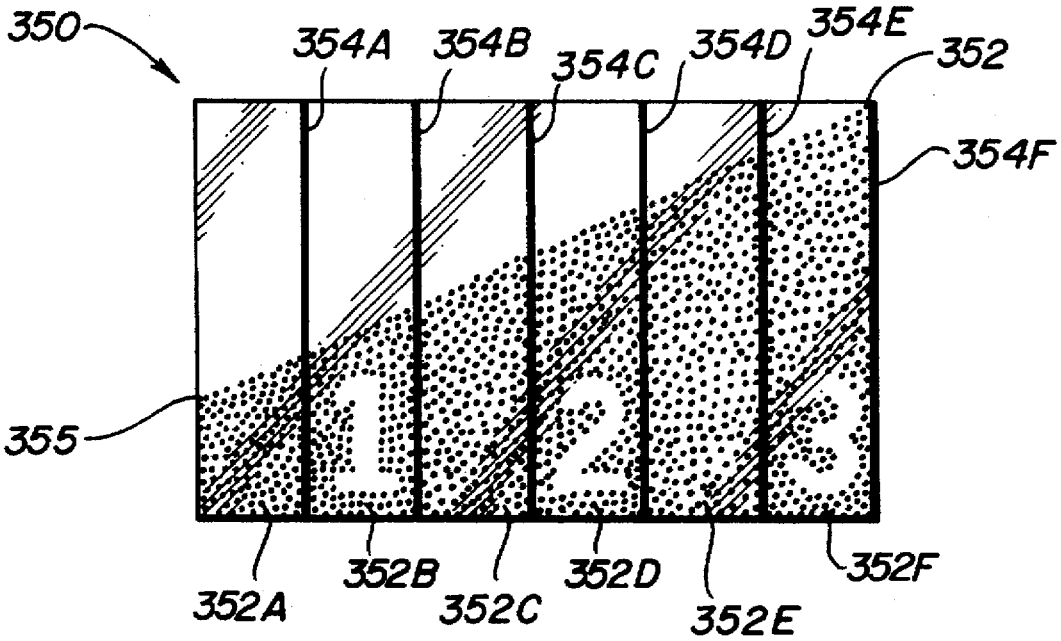

In another embodiment, depicted in FIGS. 27A and 27B, the patterned indicator is a time indicator for indicating passage of relatively long periods of time. In FIGS. 27A and 27B, a three month time indicator 350 is shown. The three month time indicator 350 comprises a substrate having a plurality of patterned areas 352A, 352B, 352C, 352D, 352E, and 352F each having a pattern of dots printed therein. The areas are partitioned by bars 354A, 354B, 354C, 354D, 354E, and 354F which are comprised of a relatively dense pattern of dots. The pattern of dots within the patterned areas 352A–F decrease in density, i.e. the dot to distance is increased, progressively from the first patterned area 352A to the last patterned area 352F. Also, there is a linear increase in the height of the pattern in each patterned areas starting at a relatively low point 355 in the first patterned area 352A, and ending at a relatively high point 357 in the last patterned are 352F, thus furthering the impression of the passage of time. In the preferred embodiment, the numbers 1, 2 and 3 are left undotted, or "stenciled" in successively in every second area 352B, 352D and 352F.

The three month timer 350 is activated by placement of an adhesive transparent film into adhesive contact with the substrate of the indicator. The adhesive underside of the film coacts with the ink of the dots to cause the ink to dissolve and migrate outward from the center of the dot. Thus, after a period of time, the dots coalesce to darken the pattern area. In the present embodiment, the dots in the first patterned area 352A, coalesce first because of the greater density with which the patterned is printed. Subsequently, the dots in the second patterned area 352B coalesce, and the stenciled number one is highlighted. The dots in the second patterned area 352B generally coalesce upon the passage of one month. While dot dissolving occurs in all patterned areas simultaneously, because of the variation in the density of the pattern in the patterned areas, dot coalescence does not cause a change visually perceptible until the passage of the specified interval.

Figure 28A:
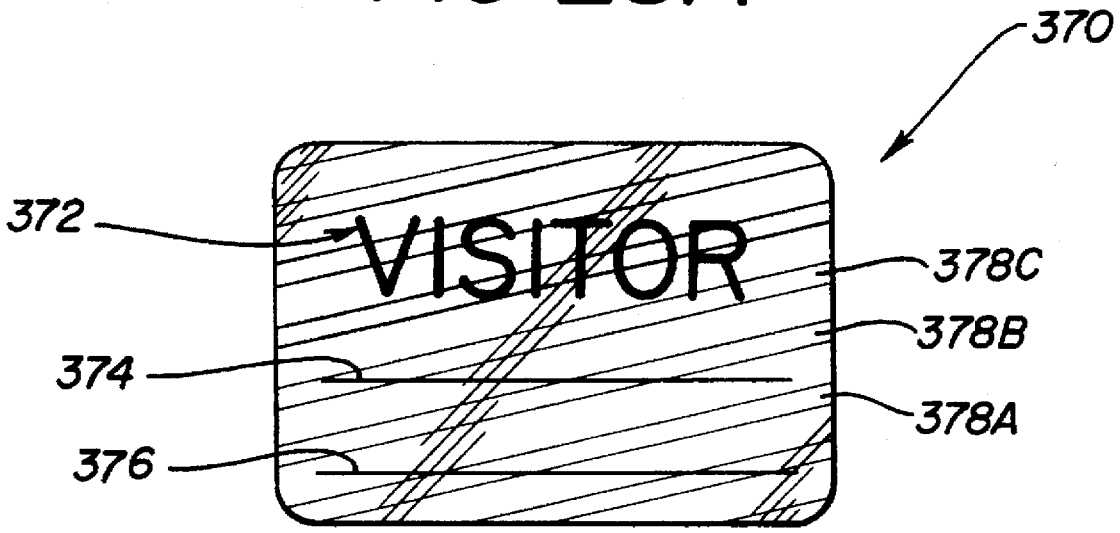
FIGS. 28A and 28B are illustrative of an alternative embodiment of a self-expiring visitor's pass in valid and expired stages respectively.
Figure 28B:
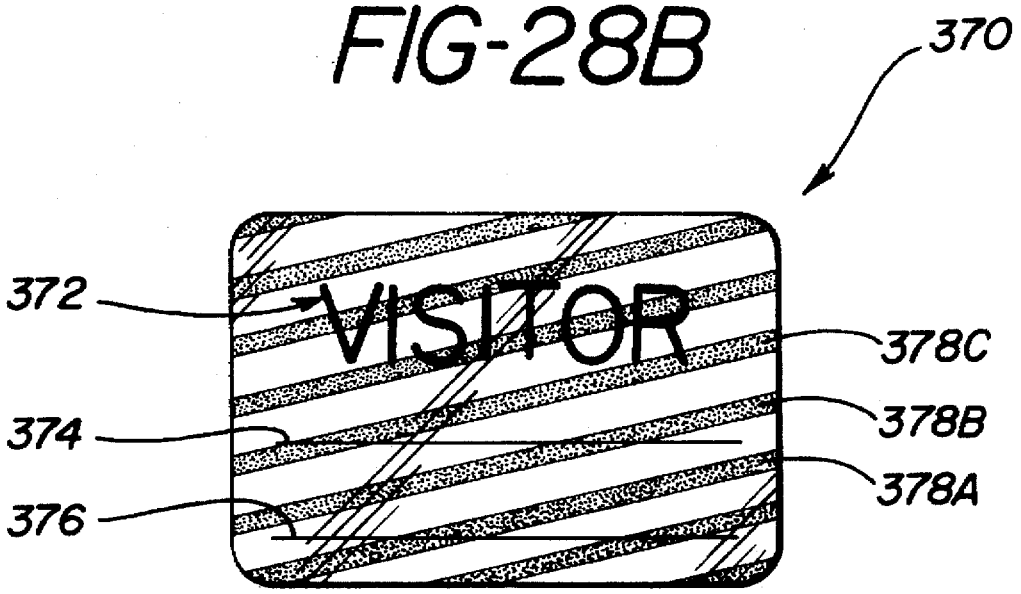
Figure 29:
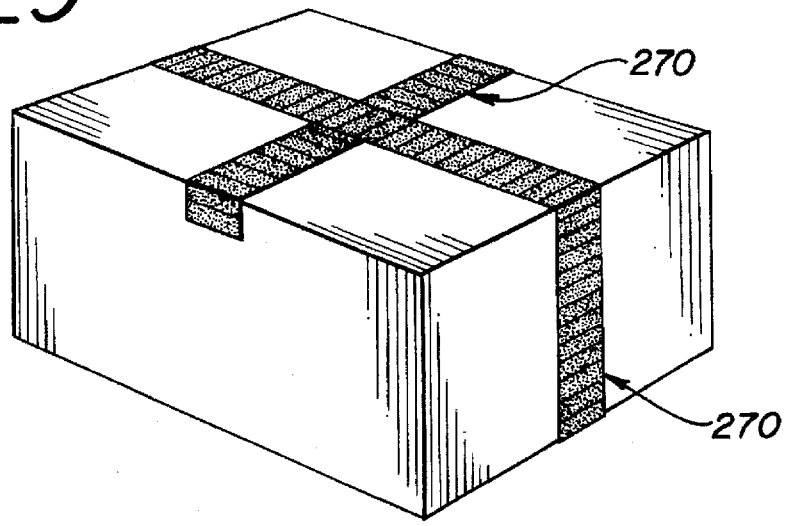
FIG. 29 is a perspective view of an embodiment of the invention in which the patterned indicator is tamper indicating packaging tape.
Figure 30:
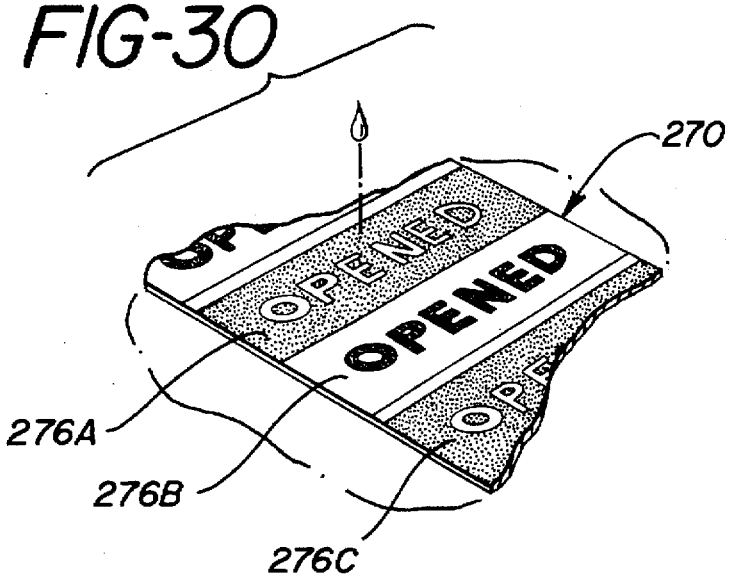
FIGS. 30 and 31 are an enlarged perspective of the tamper indicating packaging tape of FIG. 29 prior to and after tampering therewith.
Figure 31:
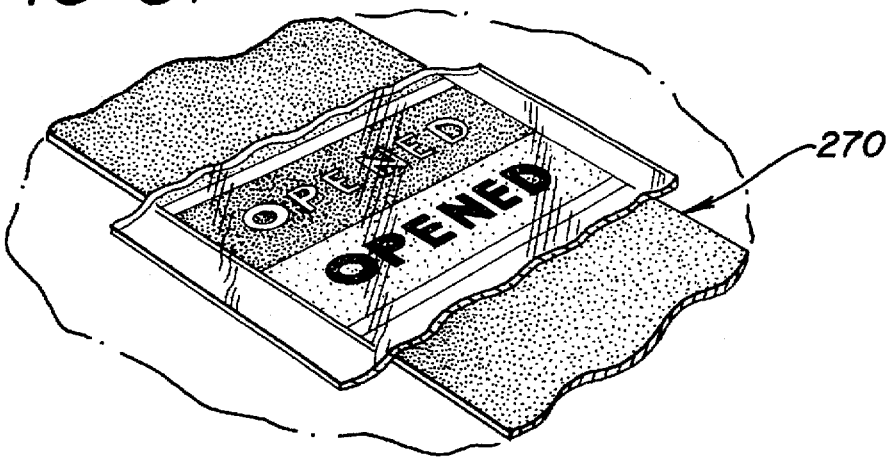

FIG. 28B depicts the three month indicator after the passage of three months from the time of activation. The passage of the specified time period is indicated by the coalescence of the dots in all patterned areas 352A–F to darken each patterned area. In another embodiment, the dots comprise soluble and nonsoluble components, and the soluble components migrate to indicate passage of the specified time period. Further, the soluble components may be of various colors so that a color change visible in the patterned areas 352A–F indicates the passage of a specified interval of time.

In another preferred embodiment, depicted in FIGS. 28A and 28B, the patterned indicator is self-expiring visitor's pass 370. In this embodiment, the pass comprises a first substrate having a pattern printed thereon, and a second transparent substrate having an adhesive activator on its underside. Information 372, ("visitor" in the embodiment shown), may be printed on the first or second substrate. Further, lines 374 and 376 are provided to allow for the inclusion of additional information.

The pattern printed on the first substrate comprises a plurality of dots printed of only a soluble ink in discrete areas. Preferably the discrete areas define diagonal bars 378A, 378B, etc. Prior to activation the pattern is not readily visible from any significant distance (i.e. greater than a few feet) because of the faintness with which the dots are printed. At issuance, the transparent substrate is placed into adhesive contact with the first surface of the first substrate. The adhesive activator coacts with the soluble ink to cause the ink to bleed and darken the discrete printed areas, thus self-expiring. Further, the dots may be printed to outline or stencil information such as the word "expired" along diagonal bars 378A, 378B, etc. Alternatively, dots of varying sizes can be employed to reveal information upon activation.

Generally, the self-expiring visitor's badge 370 of this embodiment is a low cost badge, the first substrate typically being paper. However, any badge type, including self-adhesive badges, badge inserts, paper and plastic badges, pin-feed badges, etc., are within the scope of this embodiment. Also, these badges are generally designed to self-expire within a few hours. Further, the time interval between activation and expiration may be varied by printing patterns of a greater or lessor density. For example, a very fine pattern comprising 100 to 140 dots per inch rapidly darkens, but does not become as dark as a coarse pattern of dots having 40 to 80 dots per inch. Finally, in order to assume faintness and the appearance of invisibility, all dots on the visitor's pass of this embodiment are printed of a uniform tint, generally on the order of 10%.

In another highly preferred embodiment, see FIGS. 29–33, the patterned indicator is tamper indicating packaging tape 270. The tape 270 has an adhesive on its underside for use in sealing packages. On its top side, the tape is printed with a pattern. The pattern, in the preferred embodiment, is a uniform array of dots 274. The dots 274 are typically uniform in size and shape. Also in the preferred embodiment, the pattern comprises dots of two different inks, the first being a water soluble ink and the second being an organic solvent soluble ink. The dots of the different inks are printed such that latent information is contained within the pattern. This uniform after is brought forth upon removal of one of the components (i.e. water soluble ink or organic solvent soluble ink) of the pattern. Thus, the application of water or steam to the tape, to facilitate the removal of tape, results in the removal of the water soluble dye pattern. Similarly the application of an organic solvent to the tape, to facilitate removal of the tape, removes the organic solvent soluble dye.

Removal of either the water soluble or the organic solvent soluble components of the pattern reveals the latent information of the pattern and indicates tampering with the package. See FIG. 30. Typically the water soluble and the organic solvent soluble components are arranged so that upon removal of one the latent information brought forth is the word "opened" or another such warning word which indicates tampering. The pattern is typically printed on a series of indicia areas 276A, 276B, 276C, etc., in alternating sequence such that the first ink spells a warning word in one indicia area 276B, and is surrounded by dots of the second ink, and in the next indicia area 276A the second ink spells the warning word and is surrounded by dots of the first ink. Thus, attack of the tape is indicated in each indicia area.

Further, if the tape is cut and resealed by the placement of adhesive or cellophane tape over the tamper indicating packaging tape, the adhesive on the cellophane tape acts to dissolve the organic solvent soluble component of the pattern, and cause the organic solvent soluble dots to coalesce, thereby indicating tampering. See FIG. 31. Still further, it is within the scope of the invention that dyes having a multiplicity of other and sensitivities, including heat and pressure sensitivity, could be used.

Figure 32:
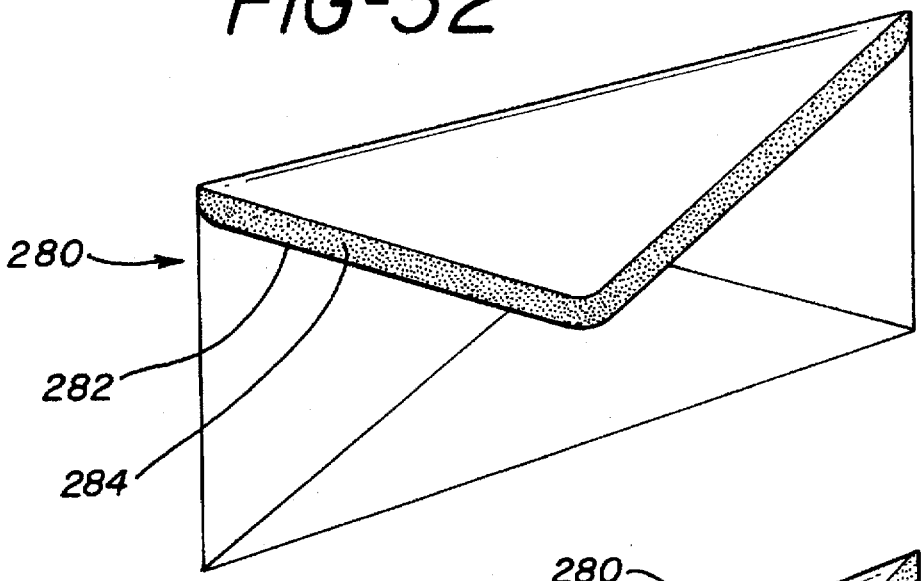
FIGS. 32 and 33 are a front view and partial front view of a tamper indicating seal of this invention on an envelope, prior to and after tampering therewith.
Figure 33:
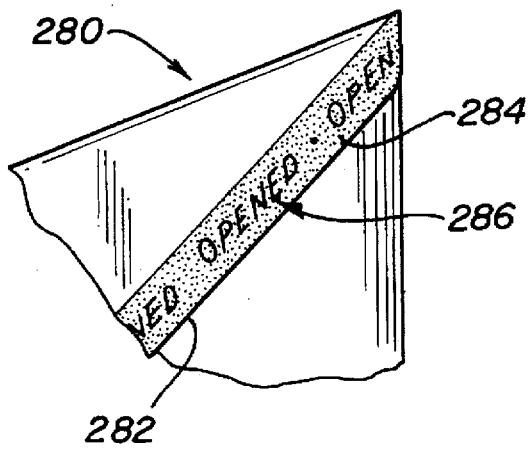
Figure 34:
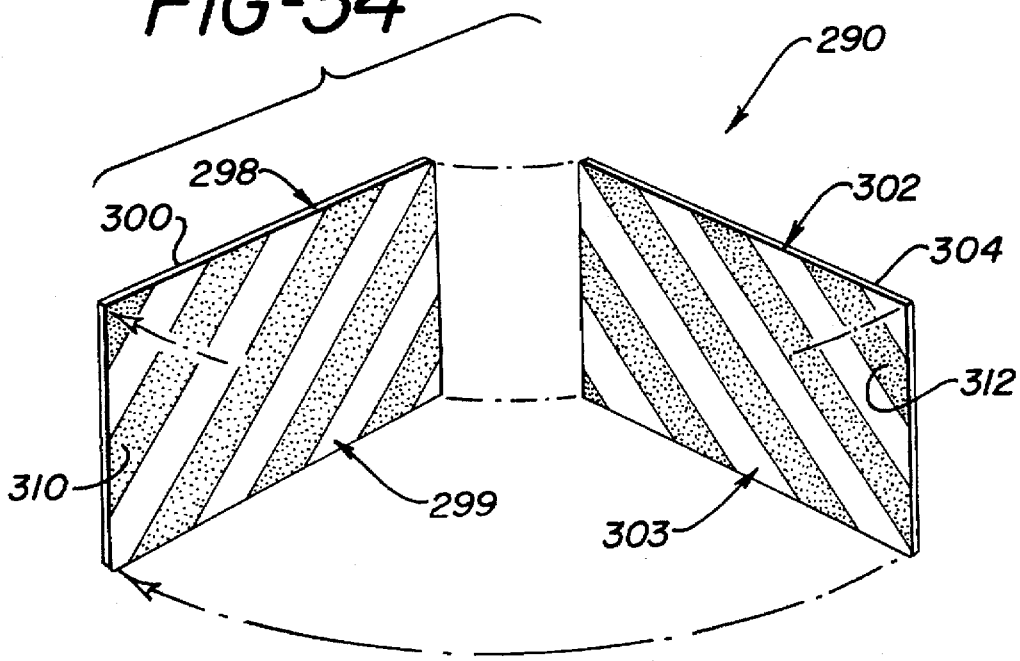
FIGS. 34, 35, 36, 37 and 38 depict an alternate embodiment of a tamper indicator for placement between overlapping leaves of a package.
Figure 35:
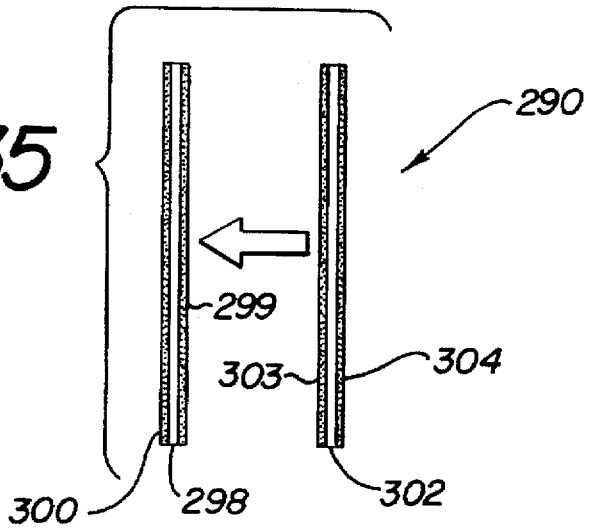
Figure 36:
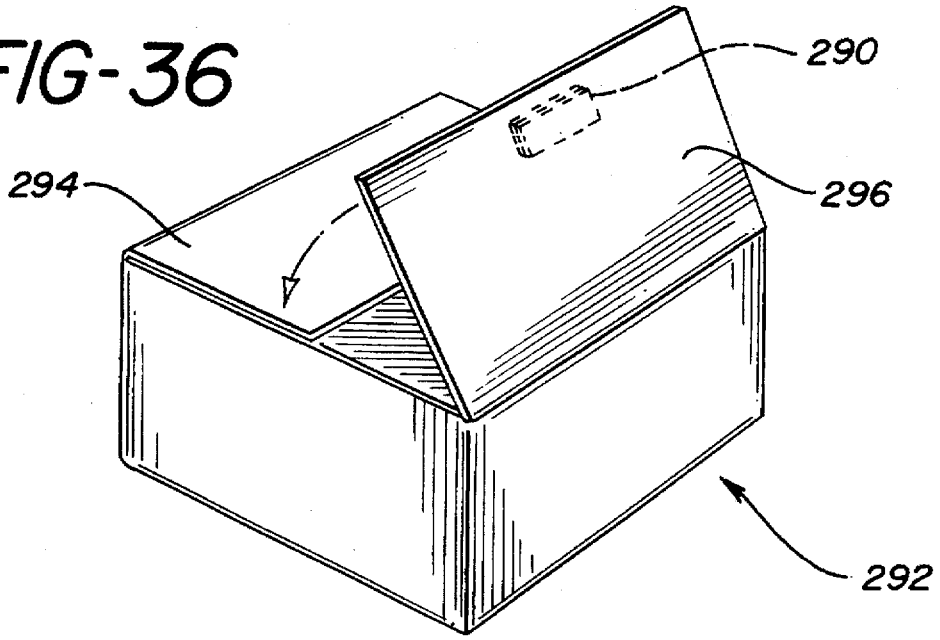

In another embodiment, FIGS. 32 and 33, the patterned indicator 182 is formed as part of an envelope 280. In this embodiment, the pattern 284 is printed along the perimeter of the envelope flap 282. The indicator functions similarly to the tamper indicating tape. Tampering with the envelope including application of an adhesive, water, steam, heat, pressure or cutting and resealing the envelope with cellophane tape, works to bring out the latent information contained in the dot pattern along the border of the envelope flap. FIG. 33 shows a section of the border of the envelope with the latent information 286 visible.

In another embodiment, FIGS. 34–38, a patterned indicator 290 for indicating the opening of a package 292 is provided. In this embodiment, the indicator is disposed between overlapping leaves 294 and 296 of the package 292. The overlapping leaves 294 and 296 of the package 292 each have an adhesive surface. The indicator 290 comprises two substrates, the first substrate 298 having a pattern 310 on its first side 299 and an adhesive on its second side 300, and the second substrate 302 having an adhesive pattern 312 on its first side 303 and an adhesive on its second side 304. The adhesive patterned first side 303 of the second substrate 302 contacts the patterned first side 299 of the first substrate 298, the pattern 310 and the adhesive pattern 312 being interdigitated. The second adhesive sides 300 and 304 of the first and second of substrates 298 and 302 face outward.

Figure 37:
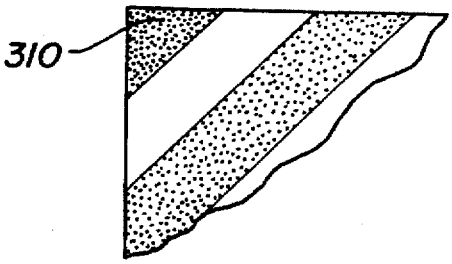
Figure 38:
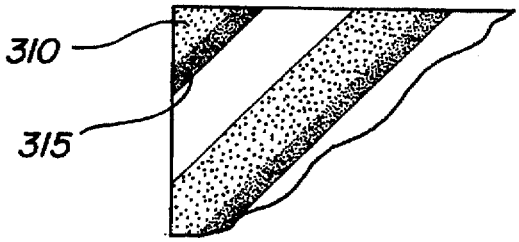

Prior to sealing the package 292, the indicator 290 is placed between overlapping leaves 294 and 296. See FIG. 36. Opening of the package will separate the first and second substrates 298 and 302 of the patterned indicator because the second adhesive sides 300 and 304 of first and second substrates 298 and 302 carry an adhesive that is stronger than the patterned adhesive on the first side, which holds the substrates 298 and 302 together. Thus, when the package 292 is opened, one substrate will adhere to one leaf and the other substrate will adhere to the other leaf. If the package is not tampered with, the pattern 310 on the first substrate 298 will be uniform as shown in FIG. 37. However, if the package is opened and resealed, upon resealment, the patterned adhesive and the pattern will be somewhat offset in position from each other, causing some of the adhesive pattern 312 to contact the pattern 310. Such contact, as seen in FIG. 38, causes bleeding and coalescence 315 of any part of the pattern in contact with the patterned adhesive. Thus, when the package reaches the end user and is opened, it can be easily seen whether the package was tampered with.

In all of the embodiments described herein which use an adhesive, almost any adhesive which is receptive to dyes or inks can be used. An adhesive that is "receptive" is an adhesive that is capable of dissolving an ink, causing the ink to migrate away from a point of application. By adding polar and/or non-polar materials to the adhesive the adsorption properties of the adhesive can be altered. Preferred adhesives are from Avery Company, Fasson Films Division, Painesville, Ohio.

The time indicator of this invention has many uses. Other embodiments include, but are not limited to:

- a self-timing sticker for visual validation of electronic access cards;
- a safety sticker that develops out warning words such as "Danger" after a specific time;
- a time-temperature food spoilage indicator, a time indicator sticker for biological industrial processes, laboratory experiments, field testing, etc. where a clock or timer is impractical or too expensive;
- a service sticker that shows words such as "Service Required" after a service or preventative maintenance time;
- a property pass/luggage tab/bar coding sticker that self-expires to prevent reuse;
- a shipping sticker that changes color to flag urgent or dated shipments that are overdue or about to be missed;
- a crime scene/frangible security seal that is tamper evident by varying printed patterns of different inks; and
- a ski ticket/entertainment park pass that self-expires.

Because of the bleeding of the dots below the second substrate in all of the embodiments described herein, there is no requirement that the ink pass through any optical barrier or opaque film. Additionally, there is no necessity for color change because the ink simply migrates to cover a larger area.

The initiation or activation of the ink migration may be by many means, for example, by heat, light, water, solvent, pressure, etc. Any stimulus that causes the color edges to spread or behave differently will produce visible information.

In all embodiments of the patterned indicator, the visually perceptible changes can be caused by an increase in dot density, or by a color variation, or both typically, a change in color may result because a dot printed with a number of component inks looks black. However, only one component may be soluble, and only that component migrates. Thus, the visible color change corresponds to the color of the soluble component of the dot.

Further, it is within the scope of this invention for the patterns to be comprised of solid ink. In such embodiments, the solid ink pattern is typically comprised of at least two components of differing colors, one of which can be bled out to produce a color change. Further, a mask can be used such that the color change only takes place in discreet areas. Thus, the solid ink pattern can withhold latent information.

Preferred inks for use with this invention are from Gans Ink Company, Los Angeles, Calif. In particular Pyroscript Sublimation Inks, e.g., Ink Nos. 57977, 57976, Heat Transfer Inks, Turn-A-Bout, Sunrise Process, Sunburst Process and Turn-A-Bout R.S. series inks. Other manufacturers include Superior Ink Co. in New York and Proflexo. Sublimation and heat transfer type inks are generally low molecular weight dyes that can bleed. Standard inks which do not bleed include particles, i.e., finely ground non-migrating solids (vis-a-vis molecules) which provide deep colors.

The adhesive activator preferably is a standard adhesive such as No. 287, manufactured by H & N Chemical Adhesives. The stimulus effect of the activator can be increased or decreased by modifying the adhesive. Adding a plasticizer to the adhesive increases the rate of migration. Typically, a plasticizer is added when the indicator is used in cold environments, while the standard cold environments, while the standard adhesive is suitable for environments over 60° F.

All of the foregoing uses of the time indicator of this invention may be accomplished by varying certain attributes of the indicator as broadly and specifically described herein.

We claim:

1. An indicator comprising:

a first substrate having first and second surfaces;

an ink pattern on said first surface of said first substrate;

a second substrate having first and second surfaces;

a chemical agent on the first surface of the second substrate;

wherein the first surfaces of each substrate overlay and are in contact with each other, the chemical agent and the ink pattern coacting to cause the ink pattern to bleed along the first surface of the first substrate to cause a visually perceptible change in the pattern over a selected time interval.

2. An indicator comprising:

a first substrate having first and second surfaces;

a second substantially transparent substrate having first and second surfaces;

an ink pattern on said first surface of said first substrate;

an ink dissolver on the first surface of the second substrate;

wherein the first surfaces of each substrate overlay and are in adhesive contact with each other, the ink and ink dissolver coacting to cause a migration of the ink along the first surface of the first substrate, causing a visually perceptible change through the transparent substrate overlaying the patterned substrate over a selected time interval.

3. An indicator comprising:

a first substrate having first and second surfaces and an indicia area on the first surface;

a second substrate having first and second surfaces; an ink pattern printed in the indicia area, comprising:

a first pattern of soluble ink;

a second pattern of insoluble ink surrounding said first pattern;

an adhesive activator means on the first surface of the second substrate;

the first surface of each substrate are put into adhesive contact, the ink and the adhesive activator coact to cause the soluble ink pattern to gradually bleed and blend together along the first surface of the first substrate to cause a visually perceptible change through the second substrate in a selected time interval.

4. The indicator of claim 3 wherein the ink pattern comprises a uniform array of dots.

5. An indicator comprising:

a first substrate having first and second surfaces and at least two indicia areas on the first surface;

a second transparent substrate having first and second surfaces;

a uniform pattern of dots printed in each of the indicia areas comprising:

a pattern of dots of a soluble ink;

dots of an insoluble ink surrounding said soluble ink dots to complete the uniform pattern;

an adhesive activator means on the first surface of the transparent substrate;

the first surface of each substrate overlay and are put into adhesive contact the soluble ink and adhesive activator coact to dissolve the dots of a soluble ink, the soluble ink dots gradually bleed and blend together along the first surface of the first substrate to cause a visually perceptible change through the transparent substrate overlaying the first indicia area in a first selected time interval, and a visually perceptible change through the transparent substrate overlaying the second indicia area in a second selected time interval, the first selected time interval differing from the second selected time interval.

6. The indicator of claim 5, wherein each ink pattern has a substantially uniform distribution of dots with a predetermined dot-to-dot distance.

7. The indicator of claim 6, wherein the dots are substantially the same geometric shape.

8. The indicator of claim 7, wherein the dot-to-dot distance of the uniform patterns of dots in the at least two indicia areas differ.

9. The indicator of claim 6, wherein the respective dot-to-dot distance of the uniform pattern of dots in the at least two indicia areas is substantially the same and each respective uniform pattern of dots has dots of differing geometric shape or size.

10. An indicator comprising:

a first substrate having first and second surfaces and an indicia area on the first surface;

a second transparent substrate having first and second surfaces;

a uniform pattern of dots printed in the indicia area;

a mask, having a pattern described there through, in an overlay arrangement with said first surface of said first substrate;

an adhesive activator means on the first surface of said transparent substrate;

when the first surfaces of each substrate are put into adhesive contact with each other, the adhesive activator contacts and coacts with the dots within the pattern described through the mask, the dots dissolving and coalescing along the first surface of the first substrate to cause a change visually perceptible through the transparent substrate in a selected time interval.

11. The indicator of claim 10 wherein the dots are substantially the same geometric shape.

12. The indicator of claim 10 wherein the indicia area comprises a plurality of indicia sub-areas, each of said sub-areas having a uniform pattern of dots printed thereon.

13. The indicator of claim 12 wherein when dots in different indicia sub-areas coalesce to cause a change visually perceptible through the transparent substrate in different selected time intervals.

14. A time parking permit comprising:

a first substrate having first and second surfaces and an indicia area on the first surface;

a second transparent substrate having first and second surfaces;

a uniform pattern of dots printed in the indicia area, comprising:

a first pattern of dots printed of a first ink;

a second pattern of dots printed of a second ink;

an adhesive activator means on the first surface of the transparent substrate;

the first substrate comprises an area extending beyond the indicia area, said extending area having a means for mounting the permit to a rearview mirror of a car;

when the first surfaces of each substrate are in adhesive contact, with each other, the adhesive activator and first ink coact to dissolve the first pattern of dots, the dots gradually bleed and blend together along the first surface of the first substrate to cause a change visually perceptible through the transparent substrate in a selected time interval to indicate that the permit has expired.

15. The parking permit of claim 14, the extending area having a slot therein for accepting the stem of a rearview mirror of a car.

16. The parking permit of claim 14 wherein the indicia area comprises a plurality of indicia sub-areas, each having a uniform pattern of dots printed thereon.

17. The parking permit of claim 16 wherein the first and second patterns comprising the uniform pattern are different in each indicia sub-area.

18. The parking permit of claim 16, wherein the uniform pattern has a substantially uniform distribution of dots with a predetermined dot-to-dot distance, in each of the indicia sub-areas.

19. The parking permit of claim 18, wherein each individual dot of the uniform pattern of dots is substantially the same geometric shape.

20. An parking permit comprising:

a first substrate having first and second surfaces and an indicia area on the first surface;

a second transparent substrate having first and second surfaces;

a uniform pattern of dots printed of a soluble ink in the indicia area;

a mask, having a pattern described there through, in an overlay arrangement with said first surface of said first substrate;

an adhesive activator means on the first surface of said transparent substrate;

the first substrate comprises an area extending beyond the indicia area, said extending area having a means for mounting the permit to a rearview mirror of a car;

the first surfaces of each substrate are in adhesive contact with each other, the adhesive activator contacts and coacts with the dots within the pattern described through the mask, the dots dissolving and coalescing along the first surface of the first substrate to cause a change visually perceptible through the transparent substrate in a selected time interval to indicate that the permit has expired.

21. The parking permit of claim 20, the extending area having a slot therein for accepting the stem of a rearview mirror of a car.

22. The parking permit of claim 20 wherein the indicia area comprises a plurality of indicia sub-areas, each of said sub-areas having a uniform pattern of dots printed thereon.

23. The parking permit of claim 12 wherein when dots in different indicia sub-areas coalesce to cause a change visually perceptible through the transparent substrate in different selected time intervals.

24. The parking permit of claim 22, wherein all of the dots of the uniform pattern are substantially the same geometric shape.

25. The parking permit of claim 22, wherein the indicia area comprises eight indicia sub-areas.

26. The parking permit of claim 25, wherein the mask includes eight patterns extending therethrough, each pattern corresponding to a separate indicia sub-area.

27. The parking permit of claim 26, wherein the patterns described through the mask one each of the letters comprising the word "expired" and an exclamation mark.

28. The parking permit of claim 23, wherein the uniform pattern of dots in each indicia sub-area has a different dot-to-dot distance.

29. The parking permit of claim 25, wherein the visually perceptible change occurs in the first indicia sub-area after one hour, in the second indicia sub-area after two hours, in the third indicia sub-area after three hours, in the fourth indicia sub-area after four hours, in the fifth indicia sub-area after five hours, in the sixth indicia sub-area after six hours, in the seventh indicia sub-area after seven hours, and in the eighth indicia sub-area after eight hours.

30. An transit ticket comprising;

a first substrate having first and second surfaces and an indicia area on the first surface;

a second transparent substrate having first and second surfaces;

a uniform pattern printed in the indicia area, comprising:

a first pattern printed of a first ink;

a second pattern printed of a second ink surrounding first said pattern;

an adhesive activator means on the first surface of the transparent substrate;

the first surfaces of each substrate are put into adhesive contact with each other, the first pattern and the adhesive activator coact to cause the first ink to bleed and blend together along the first surface of the first substrate to cause a change that is visually perceptible through the transparent substrate in a selected time interval;

wherein the first and second substrates are substantially rectangular and coextensive with each other and of a size suitable for use as a transit ticket; and the indicia area comprises a plurality of indicia sub-areas, each having a uniform pattern of dots printed thereon, wherein a visually perceptible change occurs sequentially in each indicia sub-area after an equal period of time.

31. The transit ticket of claim 30 wherein the uniform pattern comprises dots of a substantially similar geometric shape.

32. The transit ticket of claim 30 wherein the first ink is a soluble ink and the adhesive activator and the first ink coact to dissolve the dots of the first ink whereby the dots of the first ink gradually bleed and blend together to cause a visually perceptible change through the transparent substrate.

33. The transit ticket of claim 30 wherein the indicia area comprises four indicia sub-areas, each having a uniform pattern of dots printed thereon, wherein a visually perceptible change occurs in the first indicia sub-area after one week, a visually perceptible change occurs in the second indicia sub-area after two weeks, a visually perceptible change occurs in the third indicia sub-area after three weeks, and a visually perceptible change occurs in the fourth indicia sub-area after four weeks.

34. The transit ticket of claim 30, wherein the first and second patterns of dots differ in each indicia sub-area.

35. The transit ticket of claim 30, wherein the uniform pattern has a substantially uniform distribution of dots with a predetermined dot-to-dot distance, in each of the indicia sub-areas.

36. An transit ticket comprising:

a first substrate having first and second surfaces and an indicia area on the first surface;

a second transparent substrate having first and second surfaces;

a uniform pattern of dots printed of a soluble ink in the indicia area;

a mask, having a pattern described there through, in an overlay arrangement with said first surface of said first substrate;

an adhesive activator means on the first surface of said transparent substrate;

the first surfaces of each substrate are in adhesive contact with each other, the adhesive activator contacts and coacts with the dots within the pattern described through the mask, the dots thereby dissolving and coalescing along the first surface of the first substrate to cause a change visually perceptible through the transparent substrate in a selected time interval;

wherein the first and second substrates are substantially rectangular and coextensive with each other and of a size suitable for use as a transit ticket; and the indicia area comprises a plurality of indicia sub-areas, each having a uniform pattern of dots printed thereon, wherein a visually perceptible change occurs sequentially in each indicia sub-area after an equal period of time.

37. The transit ticket of claim 36, wherein the indicia area comprises four indicia sub-areas, each having a uniform pattern of dots printed thereon, wherein a visually perceptible change occurs in the first indicia sub-area after one week, a visually perceptible change occurs in the second indicia sub-area after two weeks, a visually perceptible change occurs in the third indicia sub-area after three weeks, and a visually perceptible change occurs in the fourth indicia sub-area after four weeks.

38. The substrate of claim 36, wherein all of the individual dots are substantially the same geometric shape.

39. The transit ticket of claim 37 wherein the visually perceptible change comprises the word "void", one letter of the word appearing in each indicia sub-area.

40. A self-expiring wrist band comprising:

a first elongated substrate having first and second ends and first and second surfaces and an indicia area on the first surface;

a second transparent substrate having first and second surfaces;

a uniform pattern of dots printed in the indicia area, comprising:

a first pattern of dots printed of a first ink;

a second pattern of dots printed of a second ink;

an adhesive activator means on the first surface of the transparent substrate;

means for attaching together the ends of said first substrate to encircle the wrist;

the first surface of each substrate are put into adhesive contact with each other, the adhesive activator and first ink coact to dissolve the first pattern of dots whereby the dots gradually bleed and blend together along the first surface of the first substrate to cause a change visually perceptible through the transparent substrate in a selected time interval.

41. The wrist band of claim 40 wherein the indicia area comprises a plurality of indicia sub-areas, each having a uniform pattern of dots printed thereon.

42. The wrist band of claim 41 wherein the transparent substrate extends beyond the second end of the first substrate, its adhesive underside being attachable to the first end of said of said first substrate.

43. The wrist band of claim 41, wherein a visually perceptible change appears in each indicia sub-area in different time specified intervals.

44. The wrist band of claim 40, wherein the uniform pattern has a substantially uniform distribution of dots with a predetermined dot-to-dot distance.

45. The wrist band of claim 44, wherein each individual dot of the uniform pattern of dots is substantially the same geometric shape.

46. The wrist band of claim 40, wherein the word "expired" appears along the circumference of the wrist band upon expiration.

47. A self-expiring wrist band comprising:

a first elongated substrate having first and second ends and first and second surfaces and an indicia area on the first surface;

a second transparent substrate having first and second surfaces;

a uniform pattern of dots printed of a soluble ink in the indicia area;

a mask, having a pattern described there through, in an overlay arrangement with said first surface of said first substrate;

an adhesive activator means on the first surface of said transparent substrate;

means for attaching together the ends of said first substrate to encircle the wrist;

the first surfaces of each substrate are in adhesive contact with each other, the adhesive activator contacts and coacts with the dots within the pattern described through the mask, the dots thereby dissolving and coalescing along the first surface of the first substrate to cause a change visually perceptible through the transparent substrate in a selected time interval.

48. The wrist band of claim 47 wherein the indicia area comprises a plurality of indica sub-areas, each having a uniform pattern of dots printed thereon.

49. The wrist band of claim 47 wherein the transparent substrate extends beyond the second end of the first substrate, its adhesive underside being attachable to the first end of said first substrate for securing the ticket around the wrist of the user.

50. The wrist band of claim 48 wherein a visually perceptible change appears in each indicia sub-area in different time specified intervals.

51. The wrist band of claim 47, wherein the individual dots are substantially the same geometric shape.

52. The wrist band of claim 48 wherein the visually perceptible change is the word "expired" appearing along the circumference of the wrist band to indicate expiration.

53. A self-expiring label for a pharmaceutical container label comprising:

a first substrate having first and second surfaces, and an indicia area on the first surface for printing relevant pharmaceutical information;

a second transparent substrate having first and second surfaces;

a uniform pattern of dots printed in the indicia area comprising:

a first pattern of dots printed of a first ink;

a second pattern of dots printed of a second ink;

an adhesive activator means on the first surface of the transparent substrate;

means for attaching the label to the container;

the first surfaces of each substrate are put into adhesive contact, the adhesive and the first ink coact to dissolve the first pattern of dots, the dots gradually bleed and blend together along the first surface of the first substrate to cause a change visibly perceptible through the transparent substrate in a selected time interval.

54. The self-expiring label for a pharmaceutical container of claim 53 wherein the visually perceptible change comprises angled stripes extending across the indicia area.

55. The self-expiring label for a pharmaceutical container of claim 53 wherein the selected time interval corresponds to the expiration date of the contents of the pharmaceutical container.

56. The self-expiring label for a pharmaceutical container of claim 53 wherein the visually perceptible change comprises a color change for highlighting an expiration date printed on said indicia area.

57. A self-expiring label for a pharmaceutical container comprising:

a first substrate having first and second surfaces and an indicia area on which necessary pharmaceutical information is printed and also on which a uniform pattern of dots is printed of a soluble ink;

a second transparent substrate having first and second surfaces;

a mask having a pattern described there through, and being in an overlay arrangement with the first surface of said first substrate;

an adhesive activator means on the first surface of the transparent substrate; means for attaching the label to the container;

the first surfaces of each substrate are put into adhesive contact with each other, the adhesive activator contacts and coacts with the dots within the pattern described through the mask, to cause the dots to dissolve and coalesce along the first surface of the first substrate to cause a change visually perceptible through the transparent substrate in a selected time interval.

58. The self-expiring label for a pharmaceutical container of claim 56 wherein the visually perceptible change comprises angled stripes extending across the indicia area.

59. The self-expiring label for a pharmaceutical container of claim 56 wherein the selected time interval corresponds to the expiration date of the contents of the pharmaceutical container.

60. The self-expiring label for a pharmaceutical container of claim 56 wherein the visually perceptible change comprises a color change for highlighting an expiration date printed on said indicia area.

61. A dynamic price tag comprising:

a first substrate having first and second surfaces and an indicia area on the first surface;

a price printed on said indicia area;

a second transparent substrate having first and second surfaces;

a uniform pattern of dots printed in the indicia area, comprising:

a first pattern of dots printed of a first ink;

a second pattern of dots printed of a second ink;

means for attaching the price tag to goods;

an adhesive activator means on the first surface of the transparent substrate;

the first surface of each substrate are in adhesive contact and overlay each other, the adhesive activator and first ink coact to dissolve the first pattern of dots, the dots gradually bleed and blend together along the first surface of the first substrate to cause a change visually perceptible through the transparent substrate in a selected time interval that includes a date corresponding to an expiration date of the goods with which said price tag is used.

62. The dynamic price tag of claim 61 wherein the change visually perceptible through the transparent substrate includes a darkening of the background of the price, the price becoming imperceptible.

63. The dynamic price tag of claim 61 wherein the change visually perceptible through the transparent substrate includes a second reduced price.

64. The dynamic price tag of claim 61 wherein the indicia area comprises a plurality of indicia sub-areas, each having a uniform pattern of dots printed thereon.

65. The dynamic price tag of claim 64 wherein the first and second patterns comprising the uniform pattern differs in each indicia sub-area.

66. The dynamic price tag of claim 65 wherein the charge visually perceptible through the transparent substrate is different in each indicia sub-area.

67. A dynamic price tag comprising:

a first substrate having first and second surfaces and an indicia area on the first surface;

a second transparent substrate having first and second surfaces;

a uniform pattern of dots printed of a soluble ink in the indicia area;

a mask, having a pattern described there through in an overlay arrangement with said first surface of said first substrate;

an adhesive activator means on the first surface of said transparent substrate;

means for attaching the price tag to goods;

the first surface of each substrate are in adhesive contact with each other, the adhesive activator contacts and coacts with the dots within the pattern of the mask, the dots dissolving and coalescing along the first surface of the first substrate to cause a change visibly perceptible through the transparent substrate overlaying the indicia area in a selected time interval, the change visually perceptible through the transparent substrate includes a second reduced price.

68. The dynamic price tag of claim 67 wherein the change visually perceptible through the transparent substrate includes a darkening of the background of the price, the price becoming imperceptible.

69. The dynamic price tag of claim 67 wherein the change visually perceptible through the transparent substrate includes a date corresponding to the expiration date of the goods with which said price tag is used.

70. The dynamic price tag of claim 67 wherein the indicia area comprises a plurality of indicia sub-areas, each having a uniform pattern of dots printed thereon.

71. The dynamic price tag of claim 60 wherein the first and second patterns comprising the uniform pattern differs in each indicia sub-area.

72. The dynamic price tag of claim 71 wherein the charge visually perceptible through the transparent substrate is different in each indicia sub-area.

73. A patterned indicator for indicating unauthorized opening of a package comprising:

a first substrate having first and second surfaces, said first surface having an ink pattern printed thereon and said second surface having an adhesive thereon;

a second substrate having first and second surfaces and said first surface having an adhesive pattern printed thereon, said second surface having an adhesive thereon;

wherein, when the first surfaces of the first and second substrates are put into adhesive contact, the pattern on said first surface of said first substrate and the adhesive pattern on said first surface of said second substrate interdigitate, and when the first surfaces are pulled out of adhesive contact and then put back into adhesive contact, the adhesive pattern and the pattern will become misaligned, such that the adhesive pattern will contact the pattern and cause the ink to bleed along the first surface of the first substrate.

74. The patterned indicator of claim 73 wherein said pattern comprises dots arranged along horizontal lines and the adhesive pattern is arranged in lines between the horizontal lines.

* * * * *